US012018395B2

(12) United States Patent
Horie et al.

(10) Patent No.: US 12,018,395 B2
(45) Date of Patent: Jun. 25, 2024

(54) ROUGHENED NICKEL-PLATED MATERIAL AND METHOD FOR MANUFACTURING SAME

(71) Applicant: TOYO KOHAN CO., LTD., Tokyo (JP)

(72) Inventors: Shinichirou Horie, Kudamatsu (JP); Etsuro Tsutsumi, Kudamatsu (JP); Toshifumi Koyanagi, Kudamatsu (JP); Shunki Obata, Kudamatsu (JP); Michio Kawamura, Kudamatsu (JP); Koh Yoshioka, Kudamatsu (JP); Naoharu Harada, Kudamatsu (JP); Tsuyoshi Irie, Kudamatsu (JP); Yonosuke Yoshii, Kudamatsu (JP)

(73) Assignee: TOYO KOHAN CO., LTD., Tokyo (JP)

( * ) Notice: Subject to any disclaimer, the term of this patent is extended or adjusted under 35 U.S.C. 154(b) by 0 days.

(21) Appl. No.: 17/630,274

(22) PCT Filed: Jul. 27, 2020

(86) PCT No.: PCT/JP2020/028684
§ 371 (c)(1),
(2) Date: Jan. 26, 2022

(87) PCT Pub. No.: WO2021/020338
PCT Pub. Date: Feb. 4, 2021

(65) Prior Publication Data

US 2022/0282388 A1 Sep. 8, 2022

(30) Foreign Application Priority Data

Jul. 26, 2019 (JP) ..... 2019-138340
Jan. 22, 2020 (JP) ..... 2020-008792

(51) Int. Cl.
*C25D 3/12* (2006.01)
*C25D 5/00* (2006.01)
*C25D 5/48* (2006.01)

(52) U.S. Cl.
CPC ..... *C25D 3/12* (2013.01); *C25D 5/48* (2013.01); *C25D 5/605* (2020.08)

(58) Field of Classification Search
None
See application file for complete search history.

(56) References Cited

U.S. PATENT DOCUMENTS

2020/0248328 A1* 8/2020 Huang ..... C25D 3/22
2020/0377706 A1* 12/2020 Ishida ..... B32B 27/327

FOREIGN PATENT DOCUMENTS

JP 5615795 B 4/1981
JP 2016-003378 A 6/2014
(Continued)

*Primary Examiner* — Seth Dumbris
(74) *Attorney, Agent, or Firm* — Browdy and Neimark, P.L.L.C.

(57) ABSTRACT

[Object]
To provide a roughened nickel-plated material in which the formation unevenness such as generation of the unevenness or grooves in a roughened nickel plated layer is restrained.
[Solving Means]
A roughened nickel-plated material including a base material that is a rolled material, and a roughened nickel plated layer formed on at least one surface of the base material, in which SRzjis of the surface of the roughened nickel plated layer is equal to or more than 2 μm, and, letting a maximum height of the roughened nickel plated layer be SRz, a valley region B in a given virtual planer region A as observed at a height position of SRz×0.25 satisfies the following (i). (i) The length of the valley region B in the rolling direction RD of the base material is less than 40 μm in a direct distance.

4 Claims, 25 Drawing Sheets

(56) References Cited

FOREIGN PATENT DOCUMENTS

| | | | | | |
|---|---|---|---|---|---|
| JP | 5885345 | B | | 3/2016 | |
| JP | 2019077176 | A | * | 5/2019 | ..... G06F 3/044 |
| JP | 2019-104948 | A | | 6/2019 | |
| JP | 2019-104949 | A | | 6/2019 | |

* cited by examiner

ROUGHENED NICKEL-PLATED MATERIAL AND METHOD FOR MANUFACTURING SAME

TECHNICAL FIELD

The present invention relates to a plated material having a roughened nickel plated layer and a method for manufacturing the same.

BACKGROUND ART

In recent years, in the technology for forming a plated layer on a base material such as a metallic sheet or a metallic foil, not only a technology for forming the plated layer in a flat form but also a technology for forming what is generally called a roughened plated layer in which ruggedness is formed on the plating surface or a metal is deposited in a particulate form or an acicular form on a base material has been known.

Among those above mentioned, the roughened nickel-plated material formed with a roughened nickel plated layer is used as a material for, for example, food cans, beverage cans, battery cans, and the like, for providing a function suitable for each use or for enhancing the function.

CITATION LIST

Patent Literature

[PTL 1]
Japanese Patent No. 5885345
[PTL 2]
Japanese Patent Laid-open No. 2019-104948
[PTL 3]
Japanese Patent Laid-open No. 2019-104949

SUMMARY

Technical Problem

On the other hand, depending on the above-mentioned uses, a layer of resin or the like may further be formed on the roughened nickel plated layer of the roughened nickel-plated material.

On the other hand, as a result of extensive and intensive investigations made by the present inventors, it was found out that, depending on the conditions for manufacturing the roughened nickel-plated material, the growth in the height direction in the roughened nickel plated layer may be nonuniform. Particularly, it was found out that in a case where a part where a roughened nickel plating is precipitated continuously in a specific direction of the roughened nickel-plated material but growth is difficult is generated, the part may be formed in a groove form (a groove-formed region formed by a part where growth is difficult, that is, a region where the height of each of aggregates of nickel particles in the roughened part is slightly low as compared to the surrounding roughened part is also referred to as a "groove").

Due to the presence of such unevenness or grooves in the roughened nickel plated layer, particularly in a case where another layer is formed on the roughened nickel plated layer, as indicated in pieces of PTL, the originally aimed function may not be exhibited sufficiently.

As a result of extensive and intensive investigations further conducted by the present inventors, it was found out that, by adopting a specific method in formation of the roughened nickel plated layer, the generation of unevenness or grooves in the roughened nickel plated layer as described above can be restrained.

In other words, the present invention has been made in consideration of solution to the above-mentioned problem as an example. It is an object of the present invention to provide a method for manufacturing a roughened nickel-plated material capable of restraining the generation of unevenness or grooves (hereinafter also referred to as "formation unevenness") in the roughened nickel plated layer and to provide the roughened nickel-plated material described above.

Solution to Problem

A roughened nickel-plated material in the present embodiment is characterized by (1) including a base material that is a metal and a roughened nickel plated layer formed on at least one surface of the base material, in which SRzjis of the surface of the roughened nickel plated layer is equal to or more than 2 μm, and, letting a maximum height of the roughened nickel plated layer be SRz, a valley region B in a given virtual planer region A as observed at a height position of SRz×0.25 satisfies the following (i). (i) A length of the valley region B in a rolling direction or a plate passing direction of the base material is less than 40 μm in a direct distance.

Note that in (1) above, (2) a maximum CLmax of a circumferential length CL of the valley region B is preferably less than 500 μm.

In addition, the roughened nickel-plated material in the present embodiment is characterized by (3) including a base material that is a metal and a roughened nickel plated layer formed on at least one surface of the base material. Str of three-dimensional surface property parameters of the surface of the roughened nickel plated layer is equal to or more than 0.1.

The roughened nickel-plated material in the present embodiment is characterized in that, in (3) above, (4) Sk of the three-dimensional surface property parameters of the surface of the roughened nickel plated layer is preferably 1.0 to 4.0 μm.

In addition, the roughened nickel-plated material in the present embodiment is characterized in that, in (3) above, (5) Vvc of the three-dimensional surface property parameters of the surface of the roughened nickel plated layer is preferably 0.6 to 3.0 $\mu m^3/\mu m^2$.

Further, the roughened nickel-plated material in the present embodiment is characterized in that, in (3) above, (6) Vmc of the three-dimensional surface property parameters of the surface of the roughened nickel plated layer is preferably 0.45 to 2.0 $\mu m^3/\mu m^2$.

The roughened nickel-plated material in the present embodiment is characterized in that, in any one of (1) to (6) above, (7) the base material is preferably a steel sheet.

The roughened nickel-plated material in the present embodiment is characterized in that, in any one of (1) to (7) above, (8) brightness of color of the surface of the roughened nickel plated layer is preferably 30 to 50 in L* value.

The roughened nickel-plated material in the present embodiment is characterized in that, in any one of (1) to (7) above, (9) glossiness of the surface of the roughened nickel plated layer is preferably 1.5 to 50 in 85° glossiness.

The roughened nickel-plated material in the present embodiment is characterized in that, in any one of (1) to (9) above, (10) the roughened nickel-plated material preferably includes an underlying nickel plated layer between the base material and the roughened nickel plated layer.

In addition, a method for manufacturing a roughened nickel-plated material in the present embodiment (11) includes a base material surface treatment step of making SRzjis of a surface of a base material equal to or more than 0.5 μm and less than 1.7 μm and a roughened nickel plating step of forming a roughened nickel plated layer on the base material.

Besides, the method for manufacturing the roughened nickel-plated material in the present embodiment (12) preferably includes a step of providing an underlying nickel plated layer having Sku of a surface thereof equal to or more than 4.0 on a base material that is a metal and a roughened nickel plating step of forming a roughened nickel plated layer on the underlying nickel plated layer.

In (12) above, the method for manufacturing the roughened nickel-plated material in the present embodiment is characterized in that, further, (13) Vvc of a surface of the underlying nickel plated layer is preferably equal to or less than 0.45 $\mu m^3/\mu m^2$.

Note that in (11) above, (14) the surface treatment step is preferably a cold rolling step or a temper rolling step.

In addition, in (14) above, (15) surface roughness of final rolling rolls for rolling with a reduction ratio of equal to or more than 5% in the cold rolling step is preferably 0.01 to 0.5 μm. Alternatively, in (14) above, (16) surface roughness of final rolling rolls for rolling with a reduction ratio of equal to or more than 0.1% and less than 5% in the temper rolling step is preferably 0.01 to 0.5 μm.

Further, in any one of (11) to (16) above, (17) the base material is preferably a steel sheet.

Advantageous Effect of Invention

According to the method for manufacturing a roughened nickel-plated material of the present invention, it is possible to provide a roughened nickel-plated material in which the above-mentioned formation unevenness is restrained. The roughened nickel-plated material of the present invention can, by utilizing the excellent characteristics thereof, be suitably used for, for example, beverage cans with a liquid as contents, packaging containers such as a pouch, battery members, and the like.

BRIEF DESCRIPTION OF DRAWINGS

FIG. 1(*b*) is a schematic diagram depicting a section of the roughened nickel-plated material 1 in the present embodiment.

FIG. 2(*b*) is a schematic diagram depicting the virtual planer region A of the roughened nickel plated layer 12 in the present embodiment.

FIG. 3(*e*) depicts diagrams depicting the surface and the like of the roughened nickel-plated material obtained in the present embodiment.

FIG. 6(*b*) depicts diagrams depicting the surface and the like of the roughened nickel-plated material obtained in Comparative Example of the present embodiment.

FIGS. 6(*c*), 6(*d*), 6(*e*), and 6(*f*) depict diagrams depicting the surface and the like of the roughened nickel-plated material obtained in Comparative Example of the present embodiment.

FIG. 6(*g*) depicts diagrams depicting the surface and the like of the roughened nickel-plated material obtained in Comparative Example of the present embodiment.

DESCRIPTION OF EMBODIMENT

Figure 1A:
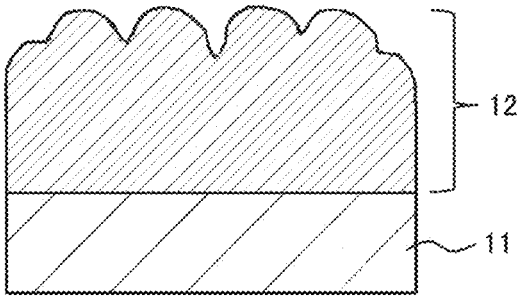
FIG. 1(*a*) is a schematic diagram depicting a section of a roughened nickel-plated material 1 in the present embodiment.

An embodiment as an example of carrying out the present invention will be described below referring to the drawings.

Figure 1B:
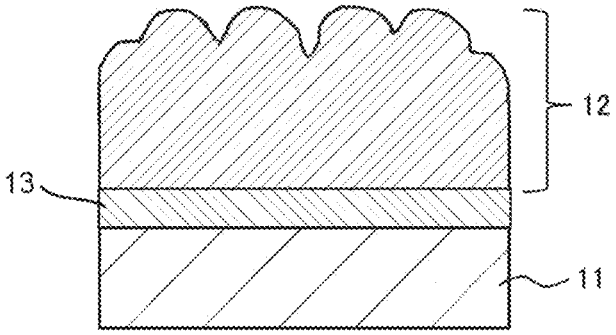

FIG. 1 is a diagram schematically depicting a roughened nickel-plated material 1 of the present embodiment. As depicted in FIG. 1(*a*), the roughened nickel-plated material 1 of the present embodiment is characterized by including a base material 11 and a roughened nickel plated layer 12 formed on at least one surface of the base material 11.

Note that, while an example in which the roughened nickel plated layer 12 is formed on one surface of the base material 11 has been presented in the present embodiment, such a mode is not limitative, and the roughened nickel plated layer 12 may be formed on both surfaces of the base material 11.

<Base Material 11>

As the base material 11 in the present embodiment, known metallic sheets or metallic foils used as a base material for plating can be applied.

Examples of the material of the base material 11 include metallic sheets or metallic foils including one pure metal selected from Fe, Cu, Al, and Ni, metallic sheets or metallic foils including an alloy containing one selected from Fe, Cu, Al, and Ni, and the like.

Specifically, the examples include a steel sheet, an iron sheet, a stainless steel sheet, an aluminum sheet, or a nickel sheet (these may be either a pure metal or an alloy, and may be foil-shaped.).

Particularly, as the steel sheet, a low-carbon aluminum-killed steel (carbon content of 0.01 to 0.15 wt %), an extremely low carbon steel having a carbon content of equal to or less than 0.01 wt % (preferably the carbon content is equal to or less than 0.003 wt %), a non-aging extremely low carbon steel obtained by adding Ti, Nb, or the like to the extremely low carbon steel, and the like are preferably used.

As the above-mentioned metallic sheet or metallic foil as the base material 11, a rolled material and an electrolytic foil can be applied. Particularly, rolled materials are preferable from the viewpoint of productivity and cost in mass production, and those which have undergone known steps such as cold rolling, annealing, and temper rolling may be used.

In addition, the metallic sheet or the metallic foil as the base material 11 may be those which has undergone a known surface treatment. Examples of the known surface treatment include various kinds of plating such as strike nickel plating applied immediately before roughened nickel plating on stainless steel sheets or nickel sheets, nickel or nickel alloy plating and zinc or zinc alloy plating applied to steel sheets, and a heat treatment applied after various kinds of plating. The base material 11 in the present embodiment may be formed with a metallic layer derived from the above-mentioned various kinds of plating or heat treatment by the known surface treatment.

The thickness of the base material 11 is preferably 0.01 to 2.0 mm, more preferably 0.025 to 1.6 mm, and further preferably 0.025 to 0.3 mm.

Note that "the thickness of the base material 11" in the present embodiment refers to an average of values obtained by acquiring an optical microscope photograph of a section of the base material 11 and measuring thickness of the base material 11 at freely-selected 10 points in the acquired optical microscope photograph. As the thickness of the base material 11 of the present embodiment, the thickness measured with a micrometer can be briefly applied.

In the present embodiment, in a case where the surface state of the base material 11 is a specific state, the roughened nickel-plated material obtained will be extremely preferable one. Detailed description will be given below.

In the present embodiment, a roughened nickel plated layer can be formed on the surface of the base material 11 by means such as electroplating. In this case, while the roughened nickel plated layer is grown by precipitation of nickel ions in the plating bath on the surface of the base material 11, it has been deduced by the present inventors' investigation that the growth degree (growth rate) of the roughened nickel plated layer partly differs depending on the surface state, particularly surface shape, of the base material 11.

In the present embodiment, as the base material 11, a rolled sheet or a rolled foil of a metal can be used. In general, these rolled sheet and rolled foil (hereinafter the rolled sheet and the rolled foil may be generically referred to as a "rolled material") can be obtained by rolling a metallic sheet by rolling rolls, it is known that the shape (ruggedness) of the roll surface of the rolling rolls contributes largely to the surface shape of the metallic sheet, and it is generally said that the shape of the roll surface is transferred.

In this instance, it is known that the surface shape formed in the rolled sheet or the rolled foil is varied depending on not only the roll surface shape (roll roughness) of the rolling rolls but also the reduction ratio, a rolling speed, hardness of the metal (object material of rolling), viscosity of a rolling oil, etc. Main examples of a surface shape of a continuous metallic strip include a recessed part like a hollow and a streak-like ruggedness along the plate passing direction. Particularly, in the rolled material, the ruggedness of the rolling rolls will not directly be the shape of the rolled material surface, but by being extended by rolling, a streak-like recessed part may be formed in the rolled material by a projected part or the like of the rolling rolls, and the streak-like recessed part is called and known as a roll mark, a rolling streak, a transfer streak, or the like.

The present inventors found out that the surface state of the base material 11, particularly, the shape (size of ruggedness, height difference, width, angle, etc.) part of the above-mentioned rolling streak, has partial differences in growth speed in the roughened nickel plated layer 12 formed on the base material 11 and that unevenness or grooves of the roughened nickel plated layer 12 are generated. In other words, the roughened nickel plated layer is precipitated even on the streak-like part, and growth of particulates progresses to a certain size, so that there is no problem as to the characteristic as a whole surface (for example, adhesion to resin or other members). On the other hand, in use to be used in an extremely tiny area or in a case where, for example, an active substance is adhered as an electrode of a battery, it is considered that there is a case where adhesion cannot be insured in an extremely microscopic region including a part of a slow growth speed. In addition, in a case where the formation unevenness is large-groove-shaped, it is considered that there is a case where formation unevenness such as difference between the adhesion in the rolling direction and the adhesion in the direction perpendicular to the rolling direction is generated.

Against such a problem, by controlling the surface state of the base material 11 as described above, generation of unevenness or grooves in the roughened nickel plated layer 12 has come to be restrained, and the present invention has been completed.

Note that, in the present embodiment, the surface state of the base material 11 was defined based on the parameters in non-contact and three-dimensional surface property measurement as follows.

Specifically, herein, SRa, SRz, and SRzjis are measured and calculated as follows.

First, two-dimensional Ra, Rz, and Rzjis are measured based on JIS B 0601 (2013).

In the present embodiment, measurement is conducted in a direction perpendicular to the rolling direction or to the plate passing direction. In addition, a measurement range is preferably equal to or more than 100 μm, more preferably 100 to 150 μm.

In addition, as the measurement of Ra, Rz, and Rzjis, the measurement is repeated multiple times while the measurement starting point in the rolling direction or the plate passing direction RD is moved, the measurement being repeated preferably 100 times or more, more preferably 300 times or more. Note that, in Examples of the present application as described later, measurement was conducted 768 times.

From the measurement results obtained, each of parameters can be obtained as follows.

$$SRa=(R_{a\text{-}1}+R_{a\text{-}2}+\ldots+R_{a\text{-}n})/n$$

$$SRz=(R_{z\text{-}1}+R_{z\text{-}2}+\ldots+R_{z\text{-}n})/n$$

$$SRzjis=(Rzjis_{_1}+Rzjis_{_2}+\ldots+Rzjis_{_n})/n$$

Note that n is the number of times of measurement.

In the present embodiment, it is preferable for the surface of the base material 11 that three-dimensional arithmetic mean height SRa be SRa=0.02 to 0.17 μm. Further, from the viewpoint of, for example, restraining of the above-mentioned formation unevenness, SRa is preferably 0.03 to 0.15 μm, and, from the viewpoint of cost, SRa is preferably 0.08 to 0.15 μm.

In a case where SRa of the surface of the base material 11 is less than 0.02 μm, not only the excessive cost is taken for the step of adjusting SRa of the surface of the base material 11, but also there is a possibility that the roughened nickel plated layer is not formed on the base material 11, or there is a possibility that the surface of the roughened nickel plated layer 12 formed on the base material 11 is too smooth and the characteristics or functions originally required of the roughened nickel plating cannot be exhibited at the maximum, which is unfavorable.

On the other hand, in a case where SRa of the surface of the base material 11 exceeds 0.17 μm, there is a possibility that the growth of the roughened nickel plated layer 12 is uneven or a possibility that grooves are generated in the roughened nickel plated layer 12 obtained, which is unfavorable.

It is further preferable for the surface of the base material 11 in the present embodiment that the three-dimensional ten point average roughness SRzjis be in the range of equal to or more than 0.3 μm and less than 1.7 μm. Further, from the viewpoint of, for example, restraining the above-mentioned formation unevenness, SRzjis is preferably 0.4 to 1.6 μm, and, from the viewpoint of cost, SRzjis is preferably 0.8 to 1.5 μm.

This is because of the following reasons. As will be described later, the present inventors found out the problem that, in a case where not points form recesses but recessed parts, such as rolling streaks, having a length or the area on the order of several tens of micrometers are present in the base material and the recessed parts are deep or in a large number or in a case where the recessed parts have a certain depth and are broad, defective growth of the roughened plating is liable to occur.

Such recessed parts having the length or the area on the order of several tens of micrometers are difficult to be distinguished by ordinary two-dimensional roughness parameters. In view of this, attention was paid to the three-dimensional ten point average roughness SRzjis calculated based on two-dimensional ten point average roughness measured in the direction perpendicular to the rolling direction or to the plate passing direction RD. Since the three-dimensional ten point average roughness SRzjis is calculated as an average for the whole surface on the basis of Rzjis measured in the direction perpendicular to RD, in the case where recessed parts having the length or the area on the order of several tens of micrometers are present in the base material surface, SRzjis is a parameter on which the total number or the length of the recessed parts are liable to be reflected.

Particularly, in a rolled material in which ridge parts are flattened by rolling as will be described later, SRzjis of the recessed parts contributes more largely. Therefore, as SRzjis in a region of 100 μm×100 to 150 μm is larger, it indicates that the number of the recesses of such a size as to cause formation unevenness of roughened plating is large on the base material or that the area of the recesses is large.

The present inventors further found out that, by making SRzjis of the base material 11 less than 1.7 μm, the valley regions of the roughened nickel plated layer 12 after roughened plating to be described later can be conspicuously restrained. Note that, although there is no limitation on the lower limit for SRzjis with respect to the purpose of reducing the recessed parts in the base material 11, SRzjis is preferably equal to or more than 0.3 μm, since, in a case of a mirror surface perfectly free of ruggedness, plating particles for forming a roughened plated layer are not liable to be precipitated in accordance with roughened plating conditions.

<Underlying Nickel Plated Layer>

In the present embodiment, an underlying nickel plated layer 13 as depicted in FIG. 1(*b*) can be formed on the base material 11, and the surface state of the underlying nickel plated layer 13 can be defined by three-dimensional surface property parameters defined in ISO-25178-2:2012 (corresponding JIS B 0681-2:2018).

Note that, as the underlying nickel plated layer 13, the contents disclosed in PTL 2 and PTL 3 and, further, Japanese Patent Application No. 2019-108779 can be applied as required, and therefore, detailed description thereof is omitted here.

In the present embodiment, in the surface of the underlying nickel plated layer 13, Sku (kurtosis) which is a parameter in which statistic of height is digitized, of the above-mentioned three-dimensional surface property parameters, is preferably equal to or more than 4.0.

The reason why Sku of the underlying nickel plated layer 13 is set to equal to or more than 4.0 is as follows. In other words, in the case where the underlying nickel plated layer 13 is formed on the base material 11, in the surface, macroscopic ruggedness of the base material 11 is somewhat mitigated by the underlying nickel plated layer 13, but microscopic fine ruggedness is formed by plating particles of the underlying nickel plated layer 13. However, in a case where, for example, rolling streaks of the base material 11 are large, streak-like valleys and ridges may not be sufficiently mitigated even after the underlying nickel plated layer 13 is formed.

Here, the present inventors found out that, in a case where a certain depth such as rolling streaks in the plane of the sheet is present in a large number in one direction after nickel plating (after formation of the underlying nickel plated layer 13), Sku representing the sharpness of height distribution of three-dimensional surface roughness well reflects the shape and is less than 4.0. In other words, the present inventors found out that it is preferable to control Sku to a value of equal to or more than 4.0, in order not to form a large groove part which can cause anisotropy after roughened nickel plating.

Note that Sku is a numerical value representing the sharpness of height distribution, and, while height distribution is normal distribution when Sku is 3.0, ordinarily, in a case where Sku exceeds 3.0, it represents that sharp ridges and valleys are present in large numbers in the surface, and in a case where Sku is less than 3.0, it represents the surface is flat. However, it was found that Sku does not represent a simple ruggedness shape.

Based on the above-mentioned findings, the present inventors made try and error and, as a result thereof, Sku of the surface of the underlying nickel plated layer 13 was set to be equal to or more than 4.0.

Further, the present inventors found out that it is preferable that Vvc which is a volume parameter of the surface of the underlying nickel plated layer 13 be set to be equal to or less than 0.45 $\mu m^3/\mu m^2$. Note that the reason why Vvc is set to be equal to or less than 0.45 $\mu m^3/\mu m^2$ is as follows.

That is, Vvc is the volume of a space of a core part when the load area rate for separating the core part and a projecting ridge part is 10% and the load area rate for separating the core part and a projecting valley part is 80%.

In other words, by reducing the space volume of the core part which is a central part of ruggedness of the surface of the underlying nickel plated layer 13, it is possible to control to reduce the groove parts which cause anisotropy after formation of the roughened nickel plated layer 12.

The present inventors found out that, by setting Vvc of the surface of the underlying nickel plated layer 13 to be equal to or less than 0.45 $\mu m^3/\mu m^2$, it is possible to restrain anisotropy of the surface of the roughened nickel-plated material after roughened plating.

<Roughened Nickel Plated Layer>

Next, the roughened nickel plated layer 12 in the present embodiment will be described.

The roughened nickel plated layer 12 in the present embodiment has a shape as if nickel particulate matter or an aggregate thereof were precipitated on the base material 11 in section, as depicted in FIG. 1. Note that the shape of the roughened nickel plated layer 12 and the like have a shape similar to that of the roughened nickel plated layer disclosed in PTL 2 or PTL 3. Therefore, in the present application, the characteristic part of the present invention, that is, the difference of the present invention from PTL 2 or PTL 3 described above will be mainly described, and the description of the points in common will be omitted.

Note that, in regard to the roughened nickel plated layer 12 in the present embodiment, the roughened nickel plated layer described in Japanese Patent Application No. 2019-108779 can be referred to, as required.

It is preferable that the three-dimensional ten point average roughness SRzjis of the surface of the roughened nickel plated layer 12 in the present embodiment be equal to or more than 2 μm. The reason is for enhancing adhesion to another member such as resin. The upper limit is not particularly present, but is 20 μm from the viewpoints of plating adhesion, production efficiency, production cost, and the like.

Note that a further preferable range of SRzjis will be as follows. In other words, from the viewpoint of more enhancing the adhesion of the roughened nickel plated layer 12 to another member, SRzjis is more preferably equal to or more than 3 μm, further preferably equal to or more than 4 μm, and still further preferably equal to or more than 5 μm.

In addition, from the viewpoint of more enhancing the adhesion (plating adhesion) of the roughened nickel plated layer 12 to the base material 11, SRzjis is more preferably equal to or less than 16 μm, further preferably equal to or less than 14 μm, and still further preferably equal to or less than 12 μm.

Besides, from the viewpoint of serious consideration of production efficiency and production cost, SRzjis is preferably 3.0 to 7.0 μm.

In addition, SRa of the roughened nickel plated layer 12 in the present embodiment is preferably SRa=0.1 to 3 μm. Further, from the viewpoint of more enhancing the adhesion of the roughened nickel plated layer 12 to another member, SRa is more preferably equal to or more than 0.18 μm, and further preferably equal to or more than 0.3 μm.

From the viewpoint of more enhancing the adhesion (plating adhesion) of the roughened nickel plated layer 12 to the base material 11, SRa is more preferably equal to or less than 1.8 μm, further preferably equal to or less than 1.6 μm, and still further preferably equal to or less than 1.3 μm.

In addition, from the viewpoint of serious consideration of production efficiency and production cost, SRa is preferably 0.18 to 0.5 μm, and more preferably 0.18 to 0.49 μm.

Brightness of color of the surface of the roughened nickel plated layer 12 is preferably 30 to 50 in L* value from the viewpoints of plating adhesion, production efficiency, production cost, and the like. In a case where the value of the brightness of color L* is less than 30, it is unfavorable from the viewpoint of plating adhesion. On the other hand, in a case where the value of the brightness of color L* exceeds 50, it is unfavorable from the viewpoint of adhesion to another member (resin layer or the like) which is possibly formed on the roughened nickel plated layer 12.

Note that the measurement of the brightness of color L* of the roughened nickel plated layer 12 can be performed by use of a spectral colorimeter by the specular component excluded (SCE) system (regular reflection light removal system) according to JIS Z 8722.

Glossiness of the roughened nickel plated layer 12 will be described next. In the present embodiment, the glossiness of the roughened nickel plated layer 12 is preferably 5 to 50 in 85° glossiness, from the viewpoints of plating adhesion, production efficiency, production cost, and the like. An 85° glossiness of less than 1.5 is unfavorable from the viewpoint of plating adhesion. On the other hand, an 85° glossiness exceeding 50 is unfavorable from the viewpoint of adhesion to a resin layer or the like which is possibly formed on the roughened nickel plated layer 12.

Note that the 85° glossiness of the surface of the roughened nickel plated layer 12 can be determined by measuring 85° mirror surface glossiness by use of a glossmeter according to JIS Z8741.

On the other hand, 60° glossiness of the roughened nickel plated layer 12 in the present embodiment is ordinarily equal to or less than 10.

In the present embodiment, chromaticities a* and b* of the surface of the roughened nickel plated layer 12 are not limited to any particular chromaticity, but from the viewpoints of plating adhesion and adhesion to a resin layer or the like which is possibly formed on the roughened nickel plated layer 12, the chromaticity a* is preferably 0.1 to 3.0, and the chromaticity b* is preferably 1.0 to 8.0.

In the present embodiment, the arithmetic mean height SRa of the surface of the roughened nickel plated layer 12 is preferably 0.1 to 3 μm. This is from the viewpoints of adhesion to a resin layer or the like which is possibly formed on the roughened nickel plated layer 12, the adhesion (plating adhesion) of the roughened nickel plated layer 12 to the base material 11, production efficiency, production cost, and the like.

The maximum height roughness SRz of the roughened nickel plated layer 12 in the present embodiment is not limited to any particular roughness, but, for example, SRz is preferably 2.5 to 25.0 μm.

Note that it is preferable that three-dimensional surface roughness SRa, SRzjis, SRz be measured by a laser microscope.

In the present embodiment, the nickel deposition amount of the roughened nickel plated layer 12 is not limited to any particular deposition amount, but, from the viewpoints of the plating adhesion and the like, the nickel deposition amount is 1.34 to 57.85 g/m$^2$. Of this, the deposition amount not including underlying nickel in the roughened nickel plated layer is 1.34 to 45.0 g/m$^2$. In addition, from the viewpoint of more enhancing the adhesion (plating adhesion) of the roughened nickel plated layer 12, the deposition amount of the roughened nickel plated layer 12 is more preferably equal to or more than 2.67 g/m$^2$, and further preferably equal to or more than 5 g/m$^2$. From the viewpoint of more enhancing the adhesion of the roughened nickel plated layer 12 to another member, the deposition amount of the roughened nickel plated layer 12 is more preferably equal to or less than 38.0 g/m$^2$, further preferably equal to or less than 32.0 g/m$^2$, and still further preferably equal to or less than 31 g/m$^2$.

In addition, the deposition amount including the underlying nickel is 5.0 to 50.00 g/m$^2$. Further, the deposition amount is more preferably 12.02 to 50.00 g/m$^2$, further preferably 12.28 to 40.94 g/m$^2$, and particularly preferably 12.28 to 32.49 g/m$^2$.

In addition, from the viewpoint of serious consideration of production efficiency and production cost, the total deposition amount of the roughened nickel plated layer 12 and the underlying metal plated layer 13 is preferably 10.24 to 22.25 g/m$^2$. Further, in a case where high corrosion resistance is required, and in a case where particularly high adhesion of the roughened nickel plated layer 12 to the metallic base material 11 and adhesion to another member are required, the total deposition amount of the roughened nickel plated layer 12 and the underlying metal plated layer 13 is preferably 32.50 to 57.85 g/m$^2$.

Note that the total deposition amount of the roughened nickel plated layer 12 and the underlying metal plated layer 13 can be determined by measuring the total nickel amount by use of a fluorescent X-ray device for a roughened nickel-plated sheet 1.

While the deposition amount of the roughened nickel plated layer 12 can be determined by measuring the total nickel amount by use of the fluorescent X-ray device for the roughened nickel-plated sheet 1, the measuring method is not limited to this method, and other known measuring methods can also be used.

In the roughened nickel plated layer 12 in the present embodiment, letting the maximum height roughness of the roughened nickel plated layer be SRz, it is preferable that a valley region B in a given virtual planer region A as observed at a height position of SRz×0.25 satisfy the following (i).

(i) The length of the valley region B in the rolling direction (plate passing direction) RD of the base material is less than 50 μm in a direct distance.

Note that it is further preferable that the valley region B satisfy the following (ii).

(ii) The total length of parts where the valley region B is present in a length of equal to or more than 10 μm in the rolling direction RD of the base material, in a given straight-line length of 80 μm, is less than 50 μm.

Description using drawings will be given below.

Figure 2A:
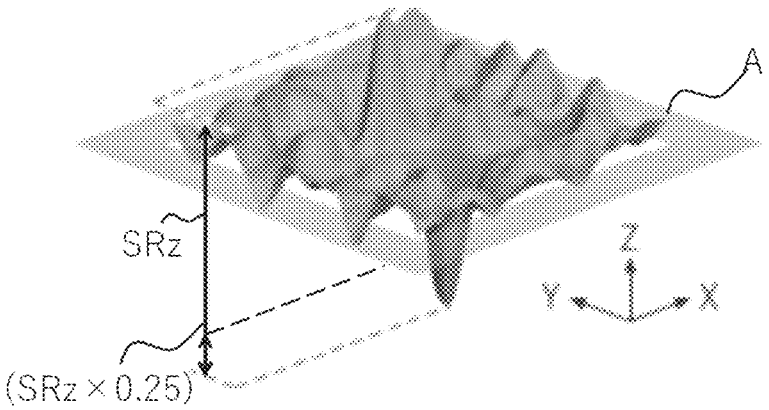
FIG. 2(*a*) is a schematic diagram depicting a virtual planer region A of a roughened nickel plated layer 12 in the present embodiment.
Figure 2B:
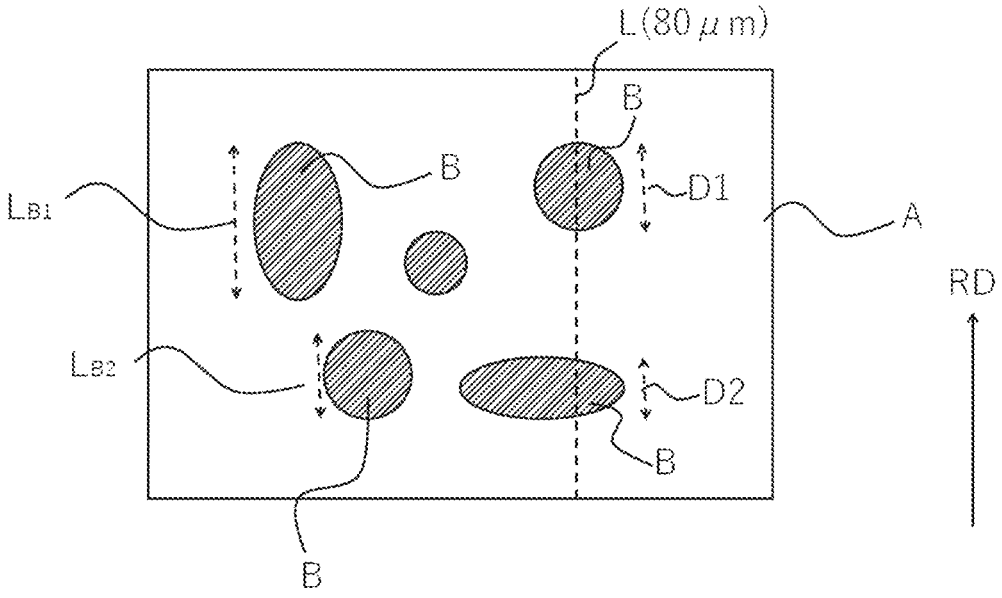
Figure 3A:
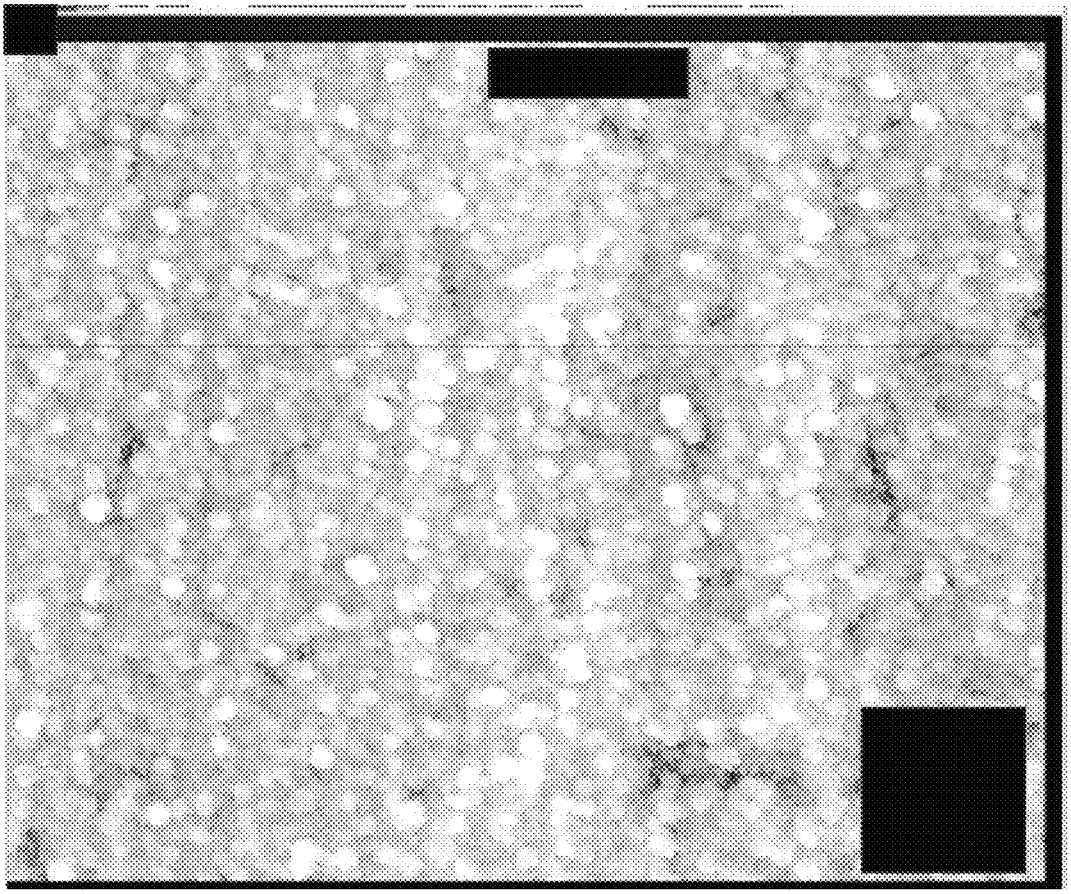
FIGS. 3(*a*), 3(*b*), 3(*c*), and 3(*d*) depict diagrams depicting the surface and the like of a roughened nickel-plated material obtained in the present embodiment.
Figure 3B:
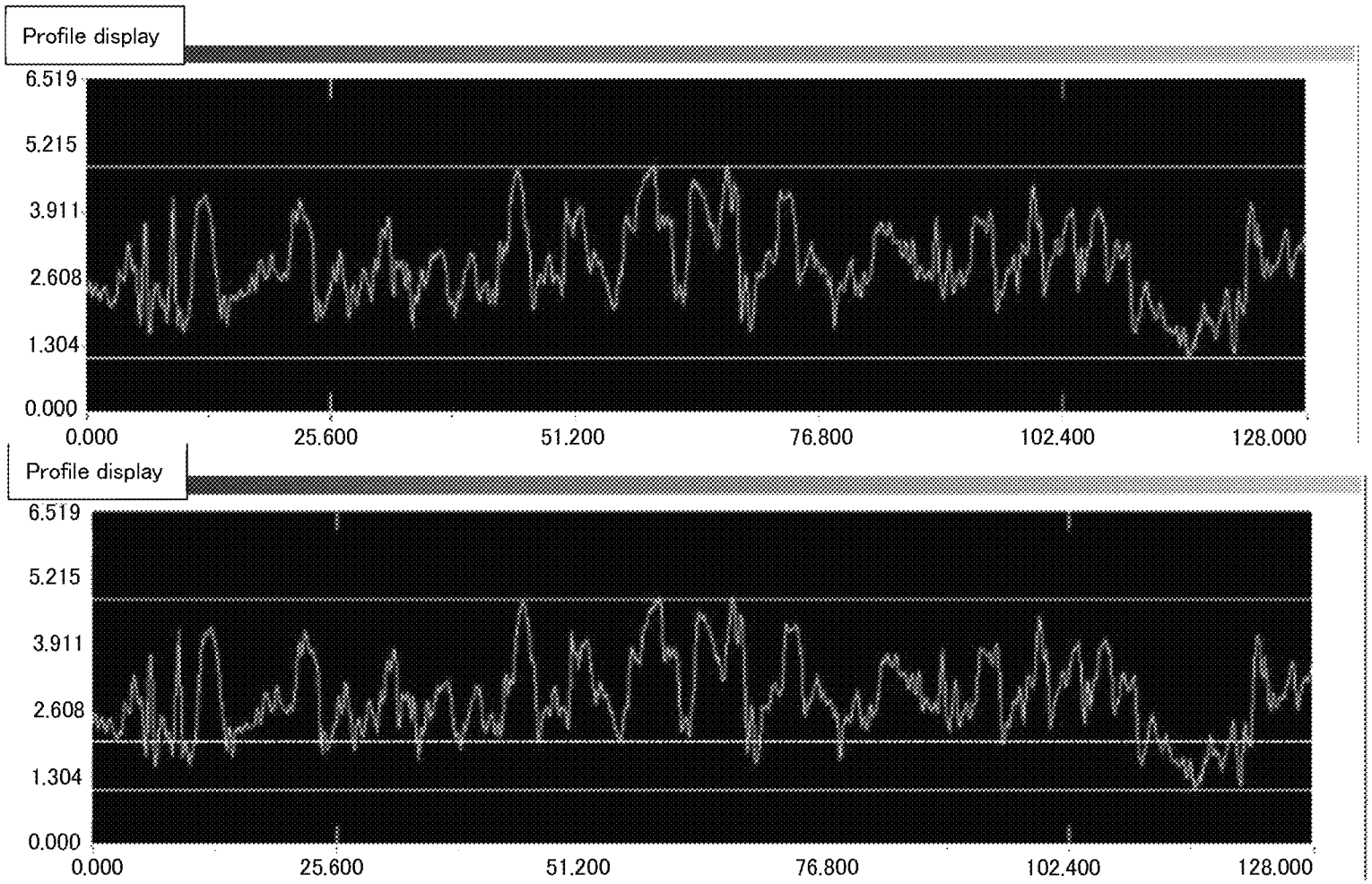
Figure 3C:
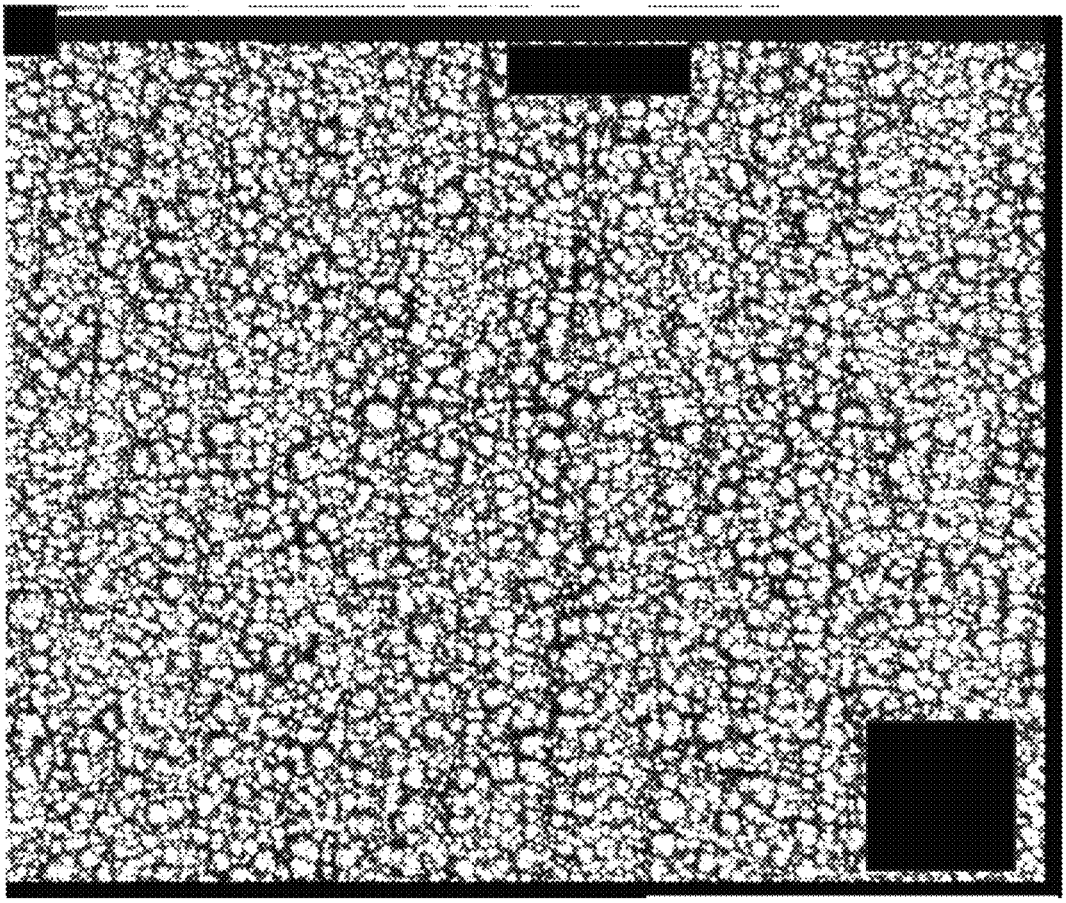
Figure 3D:
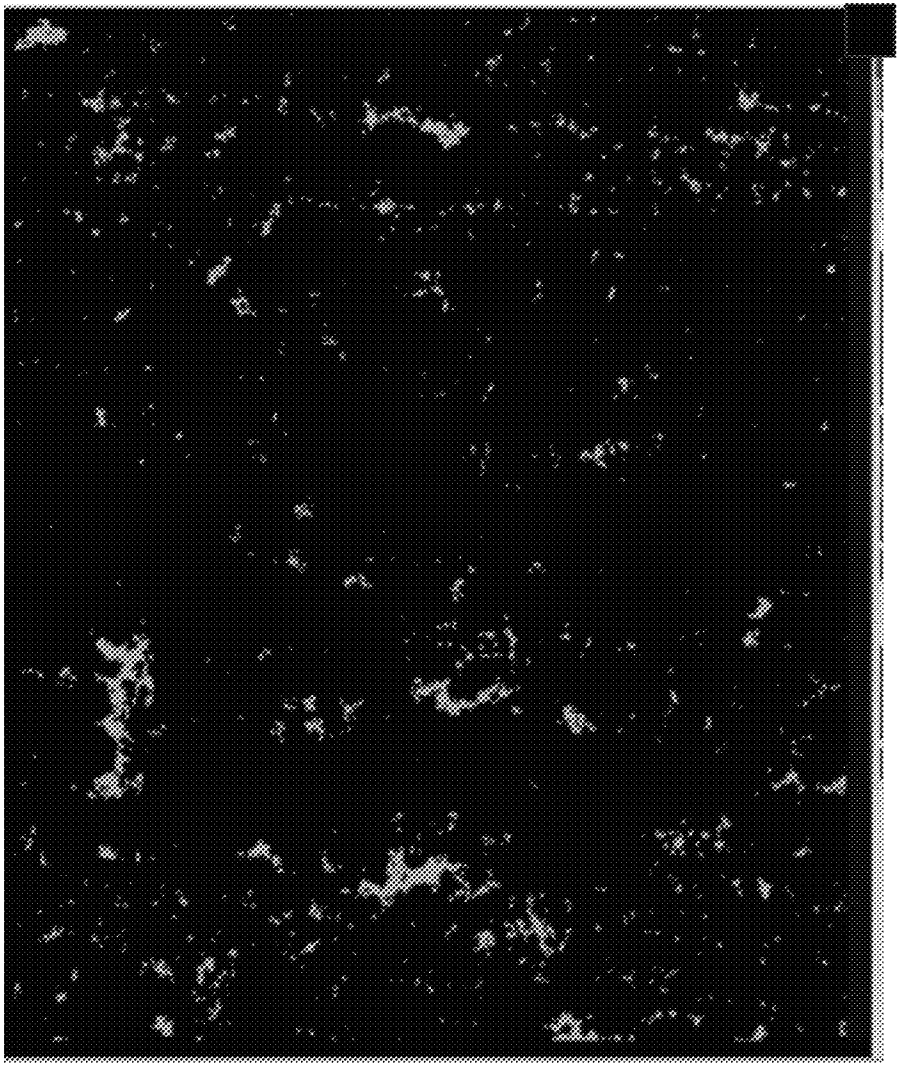
Figure 4A:
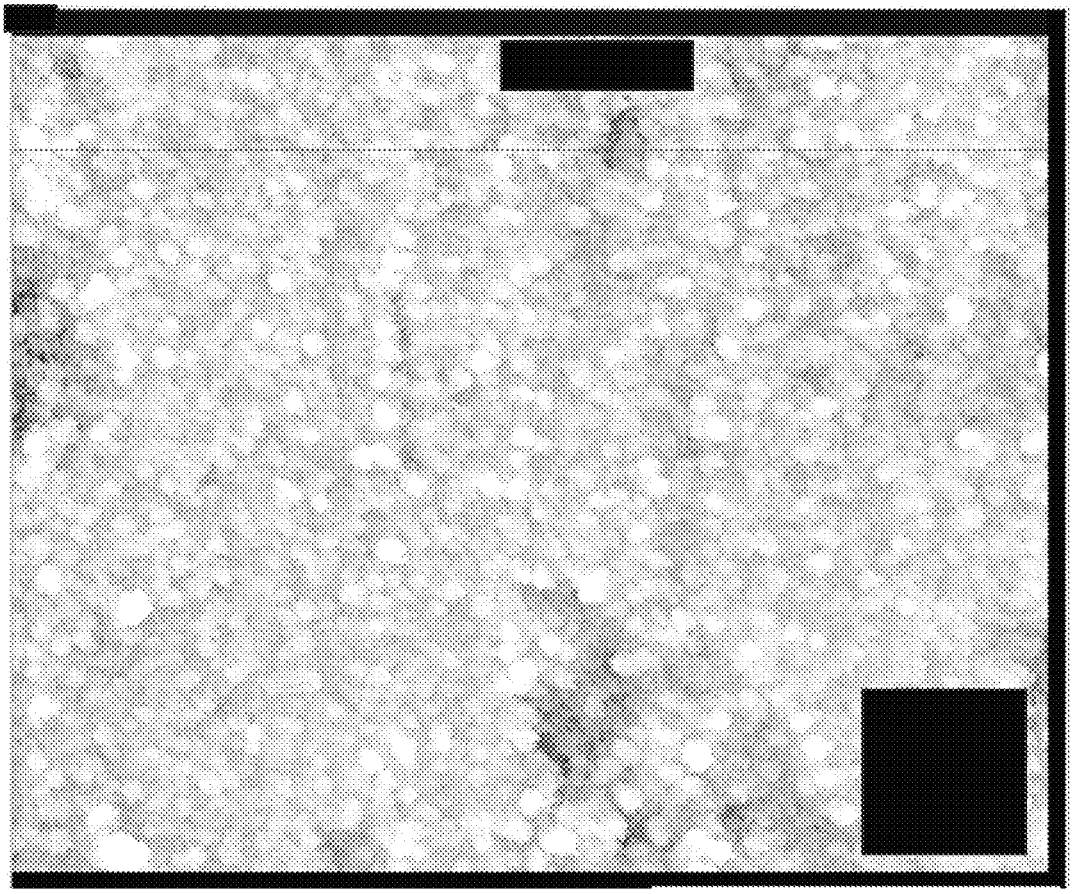
FIGS. 4(*a*), 4(*b*), 4(*c*), and 4(*d*) depict diagrams depicting the surface and the like of the roughened nickel-plated material obtained in the present embodiment.
Figure 4B:
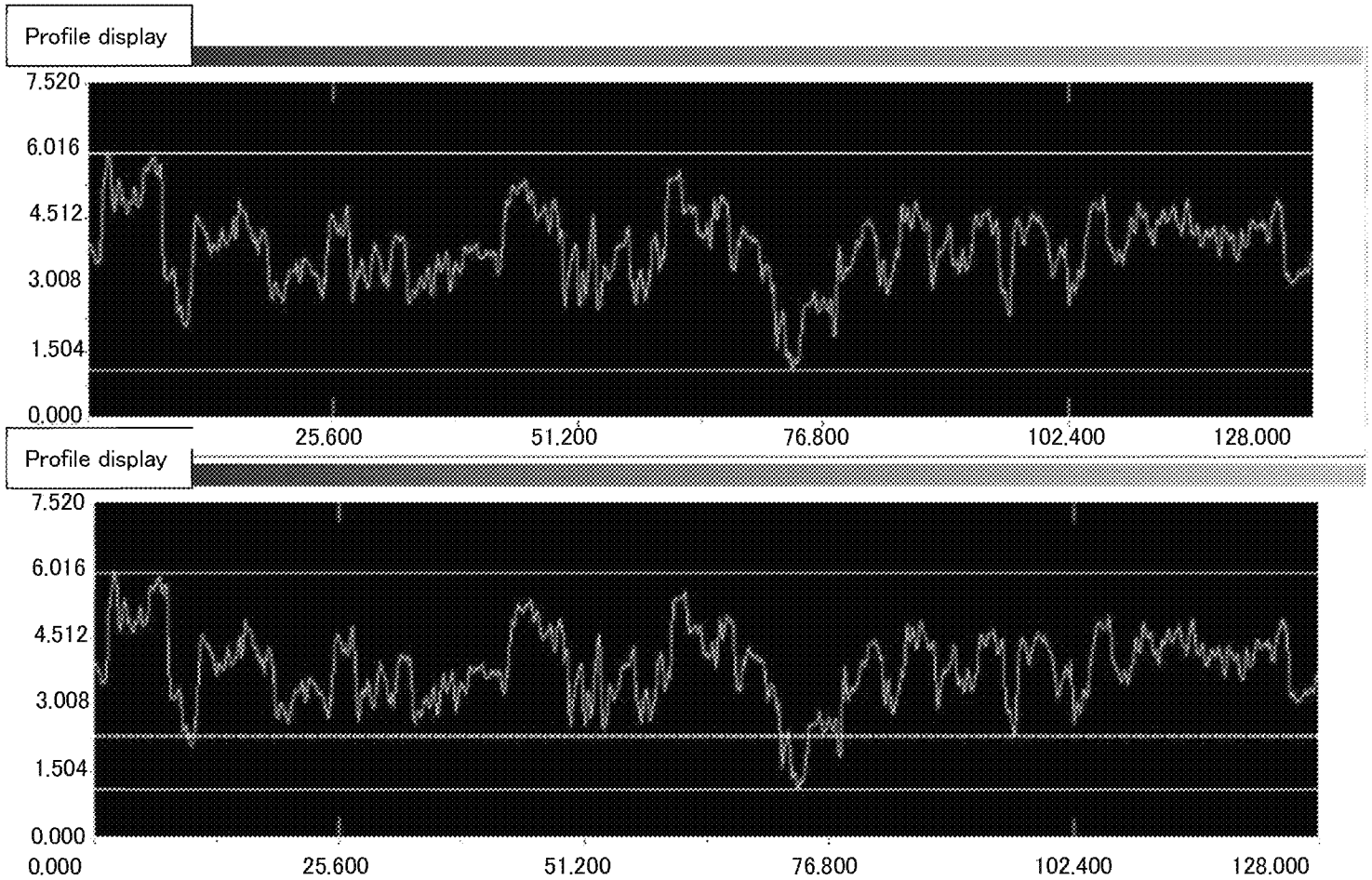
Figure 4C:
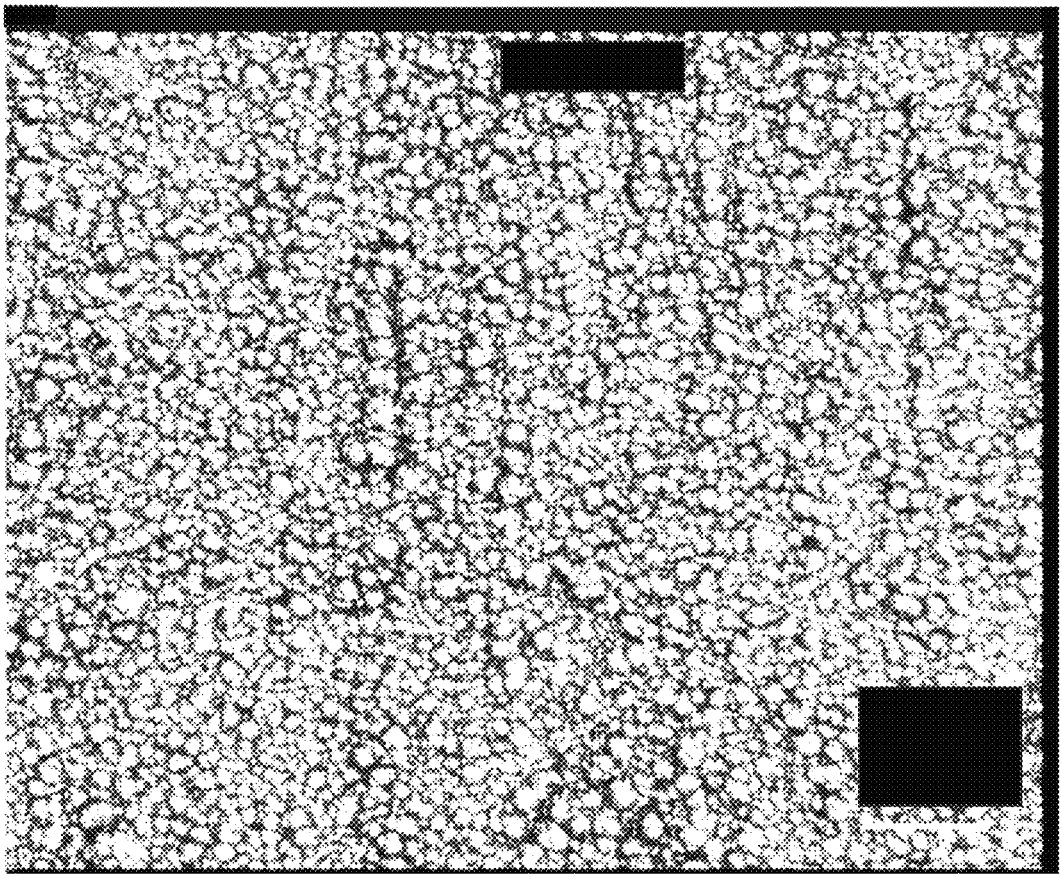
Figure 4D:
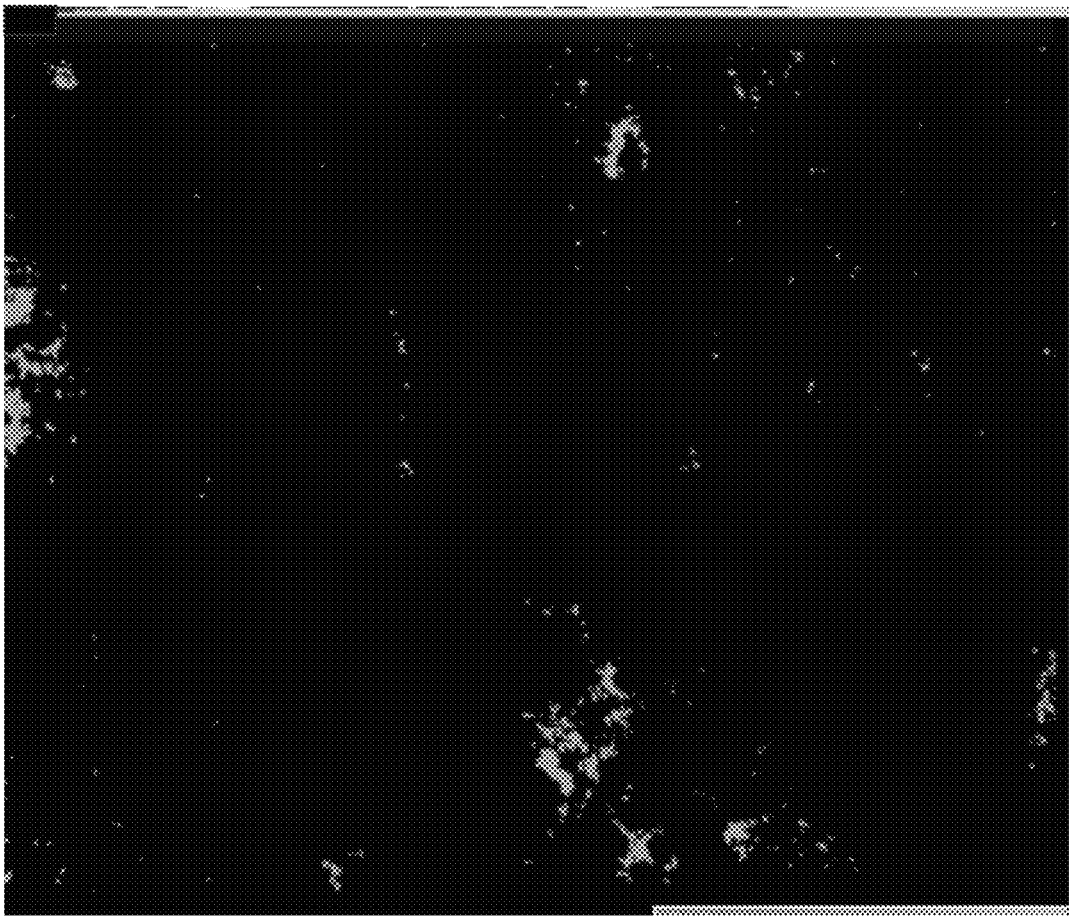
Figure 5A:
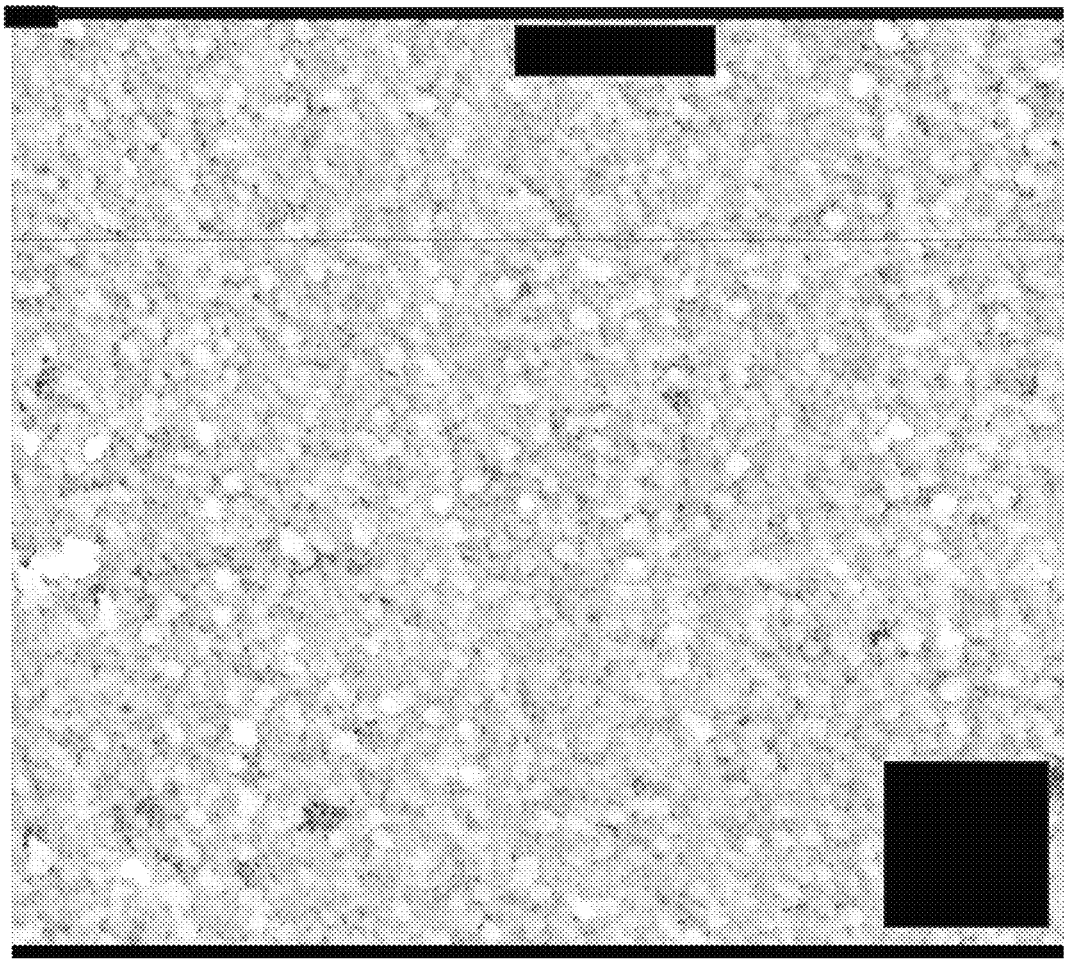
FIGS. 5(*a*), 5(*b*), 5(*c*), 5(*d*), 5(*e*), 5(*f*), 5(*g*), and 5(*h*) depict diagrams depicting the surface and the like of the roughened nickel-plated material obtained in the present embodiment.
Figure 5B:
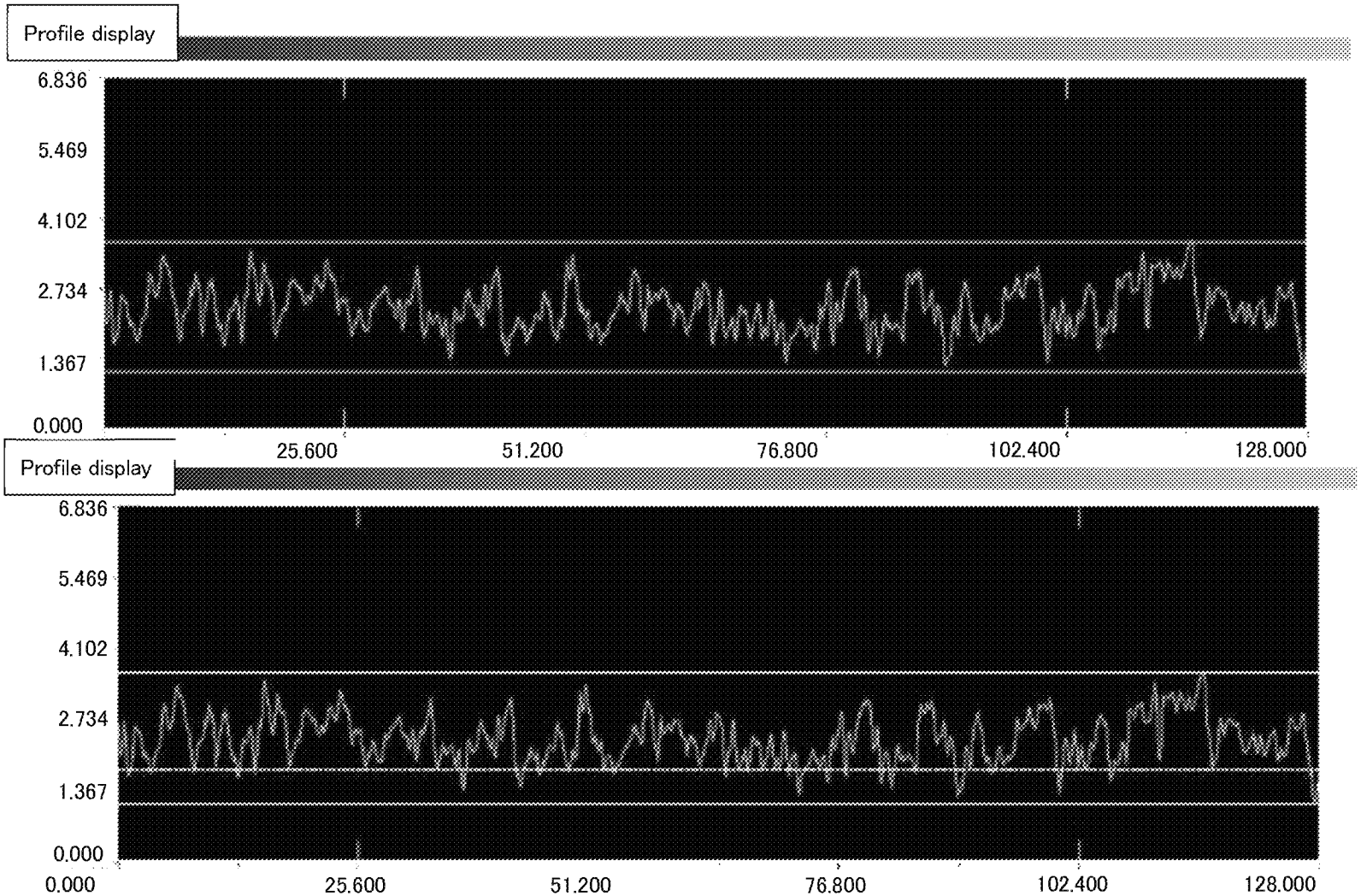
Figure 5C:
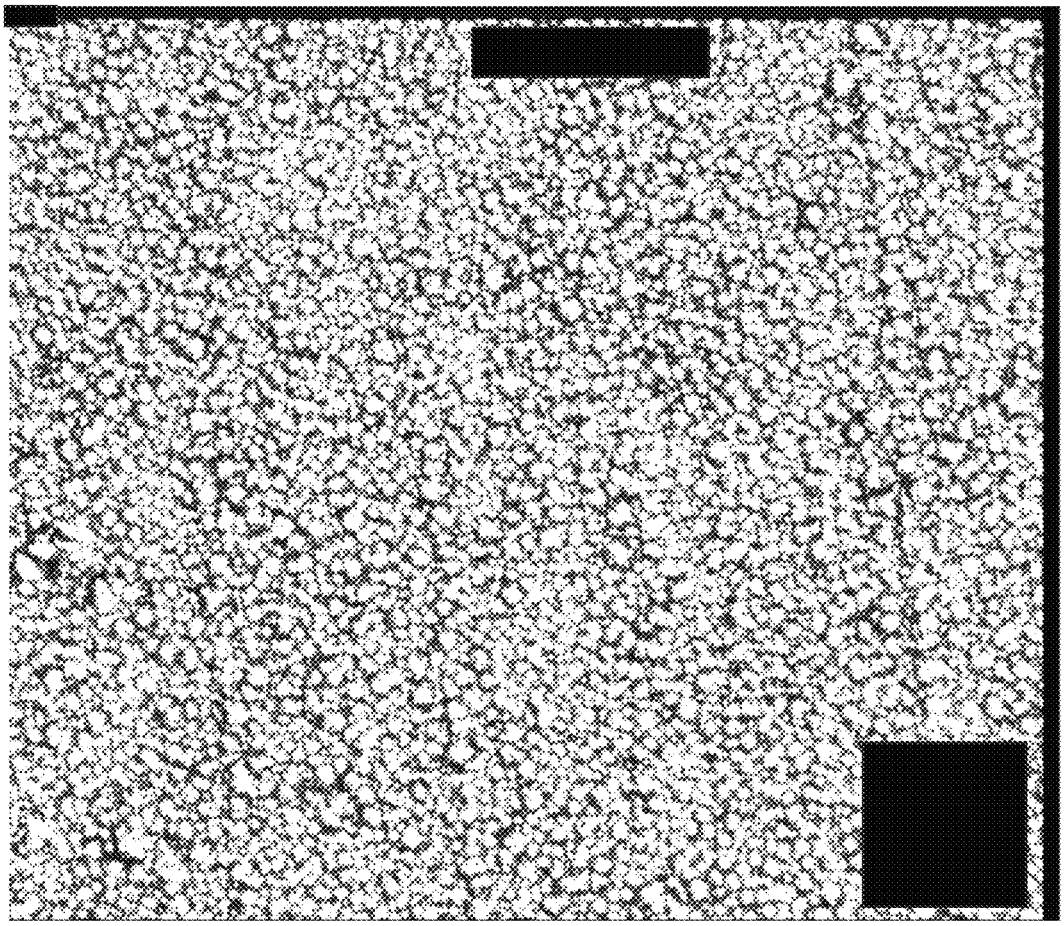
Figure 5D:
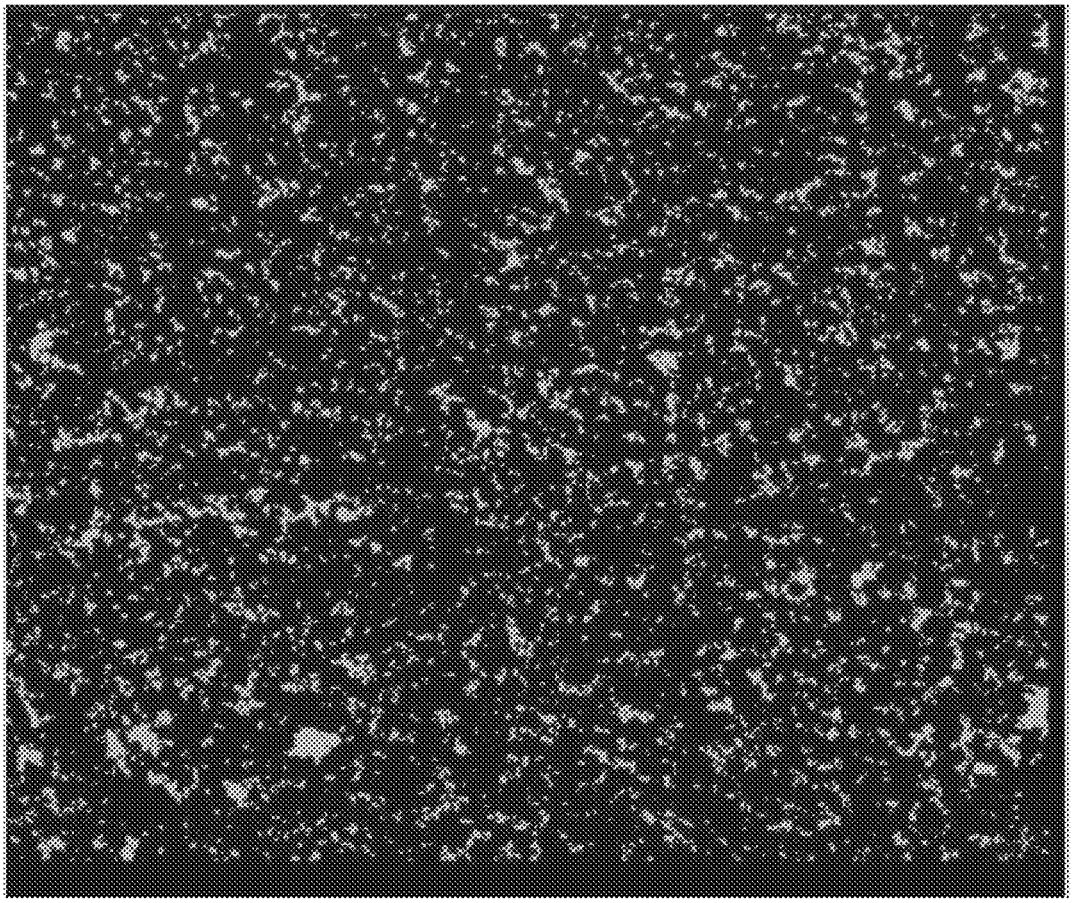
Figure 5E:
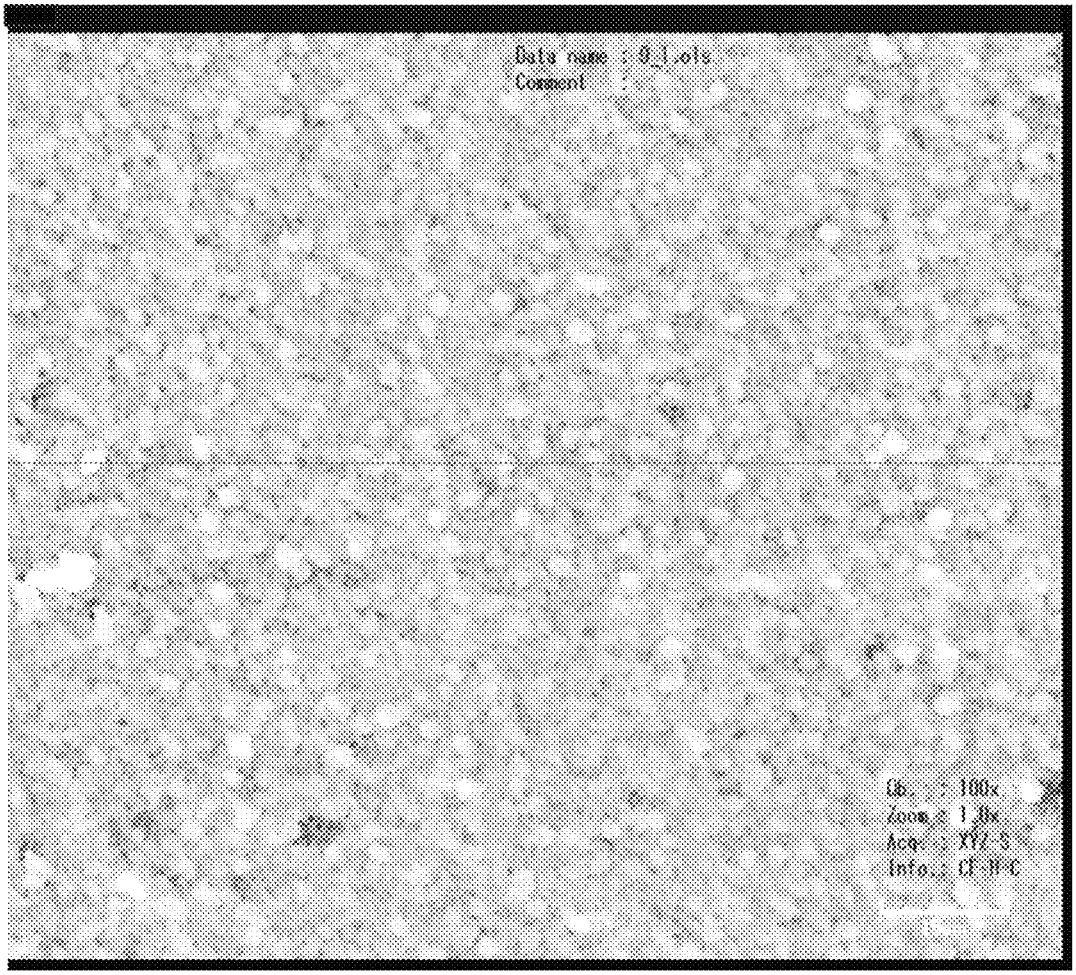
Figure 5F:
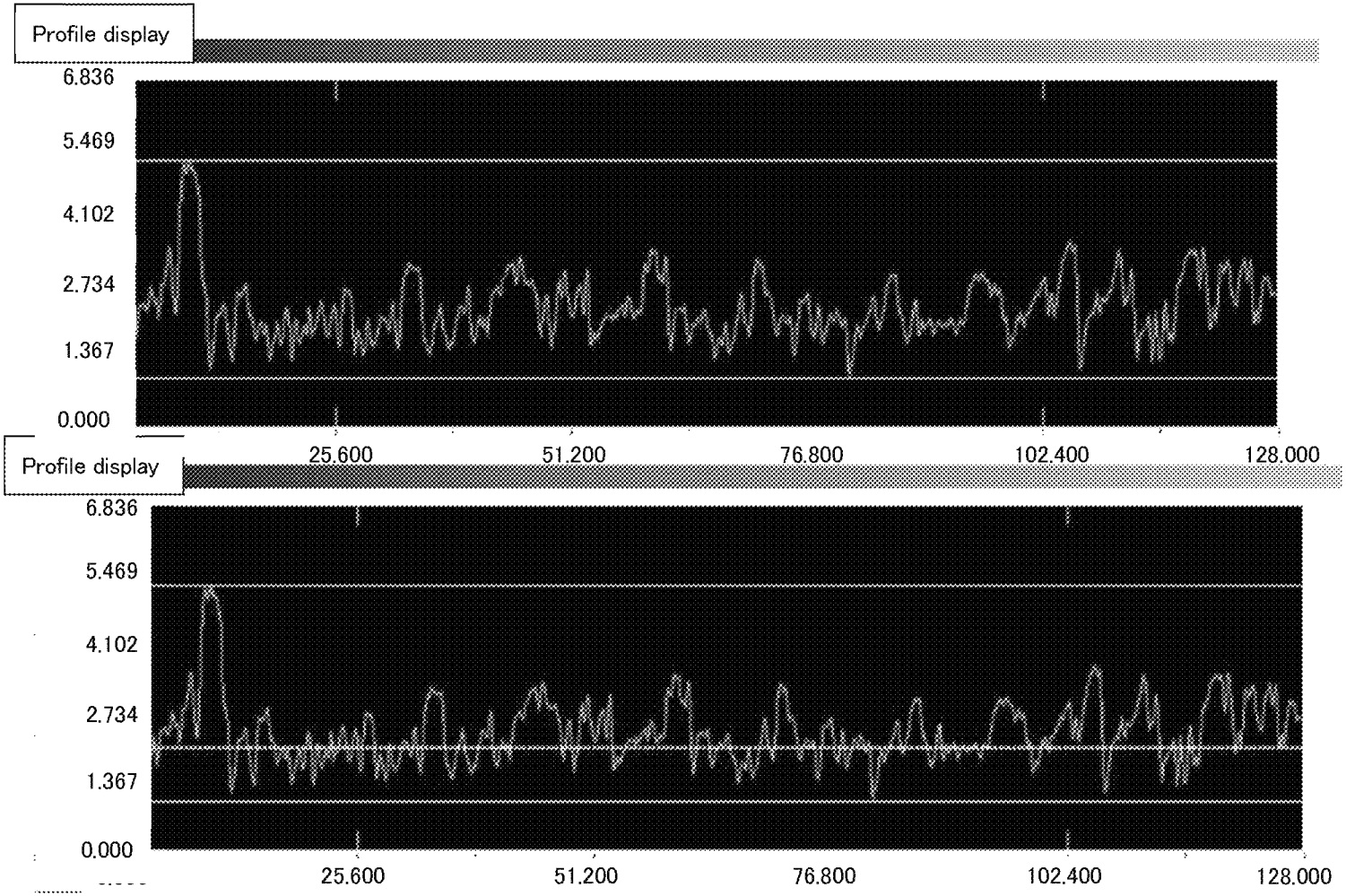
Figure 5G:
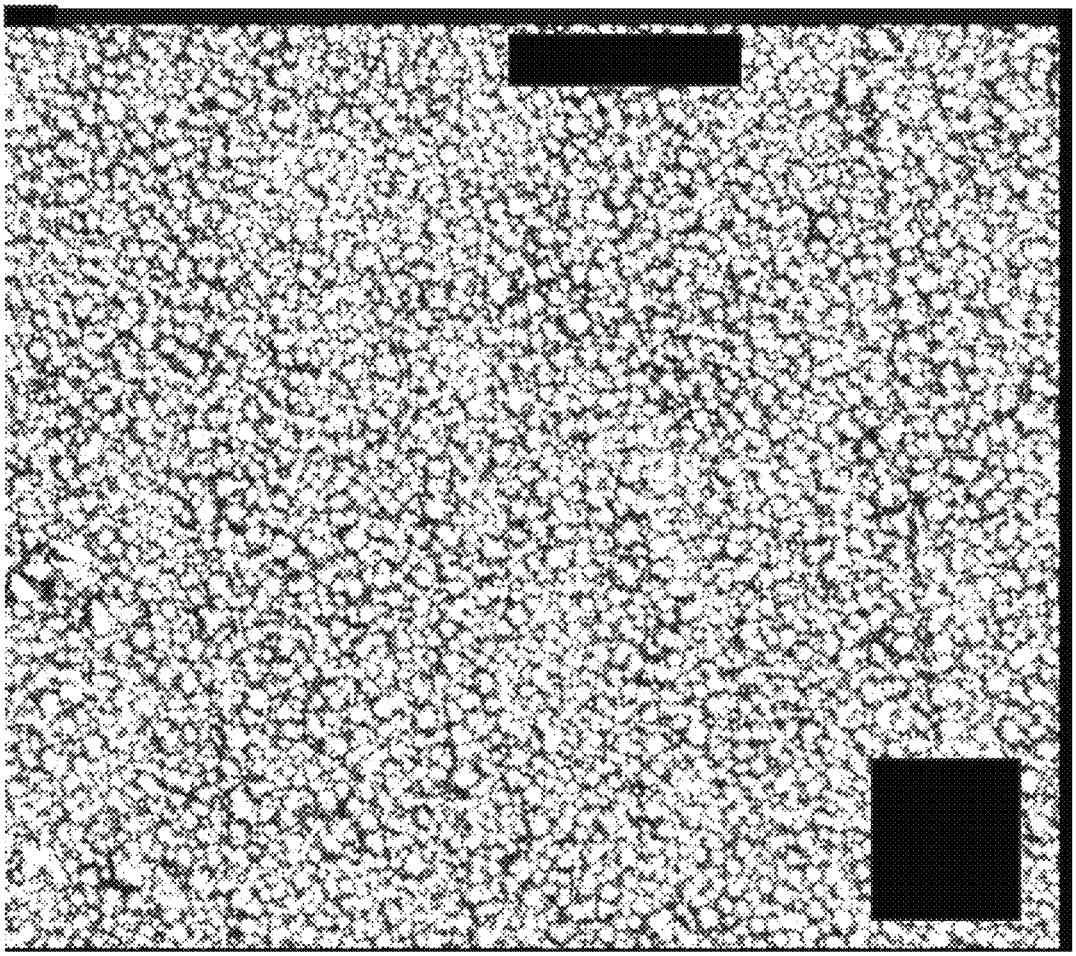
Figure 5H:
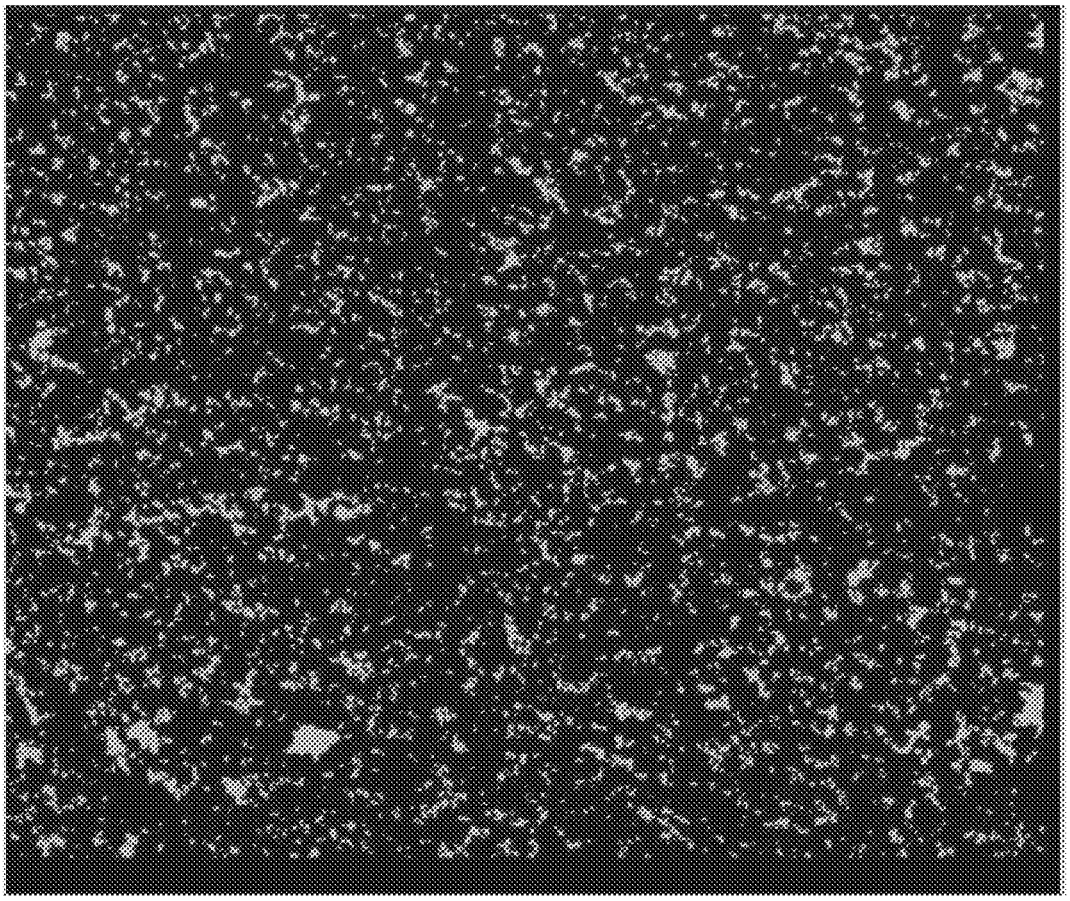
Figure 6A:
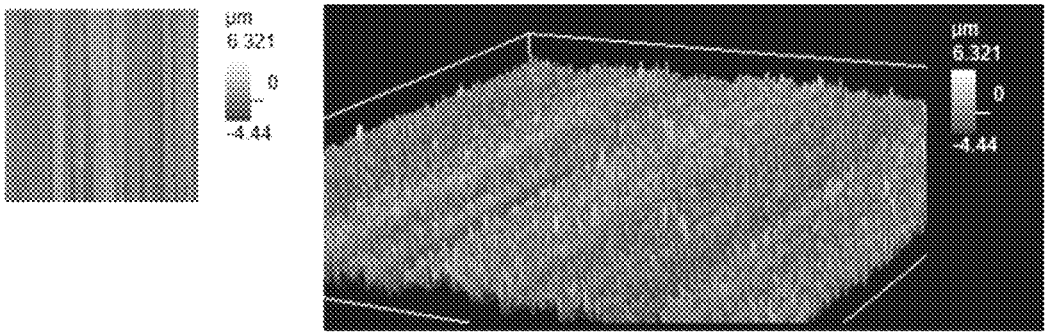
FIG. 6(*a*) depicts diagrams depicting the surface and the like of a roughened nickel-plated material obtained in Comparative Example of the present embodiment.
Figure 6B:
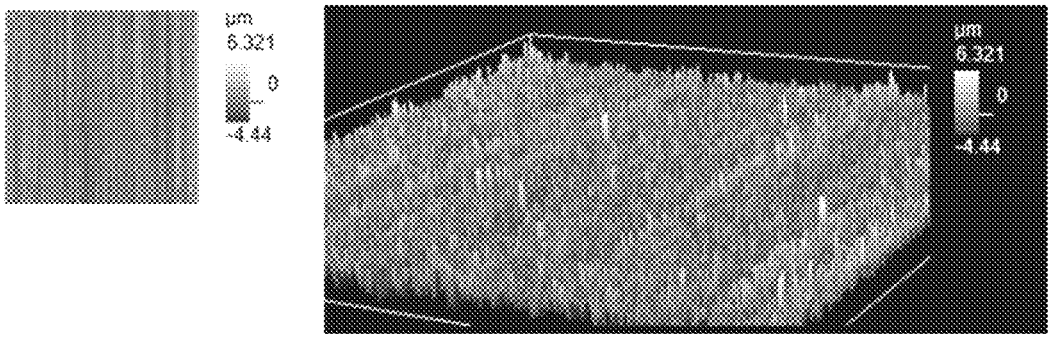
Figure 6C:
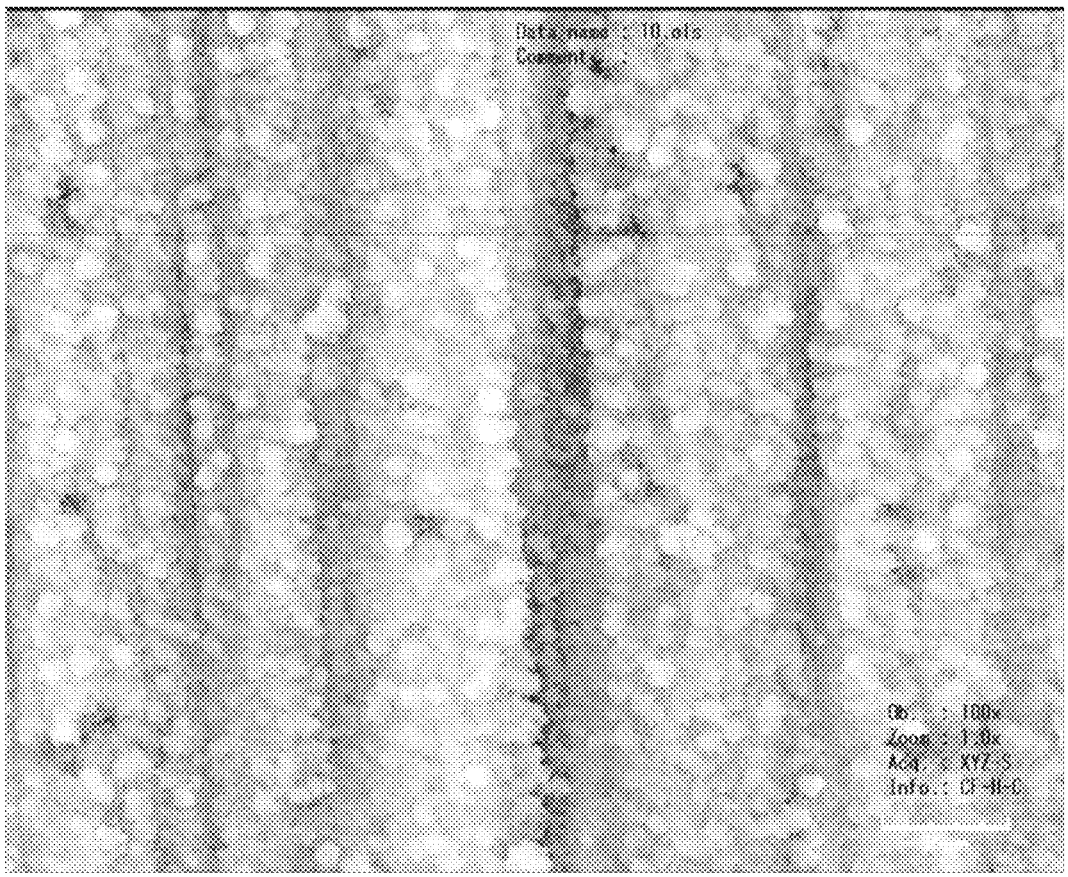
Figure 6D:
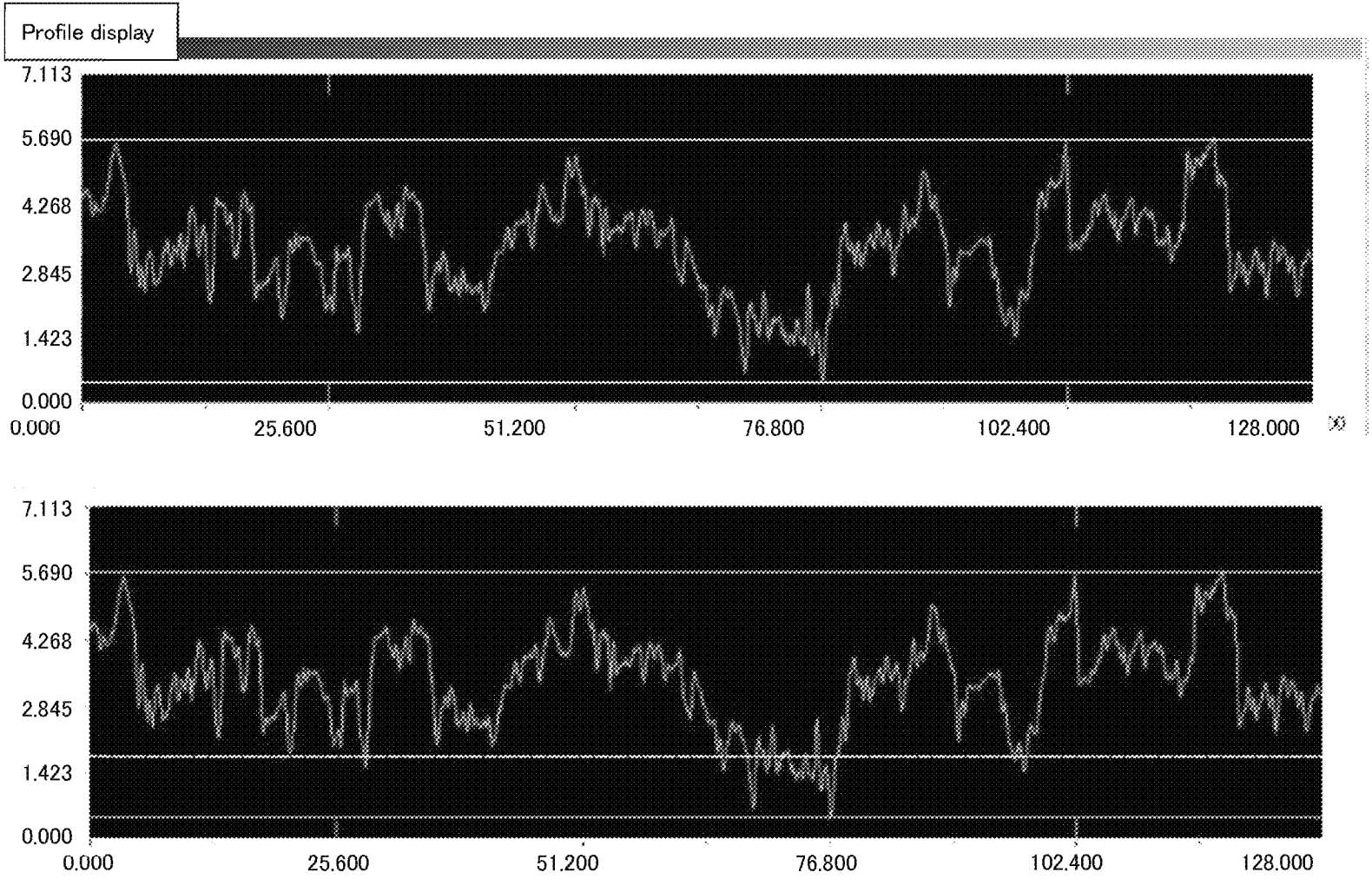
Figure 6E:
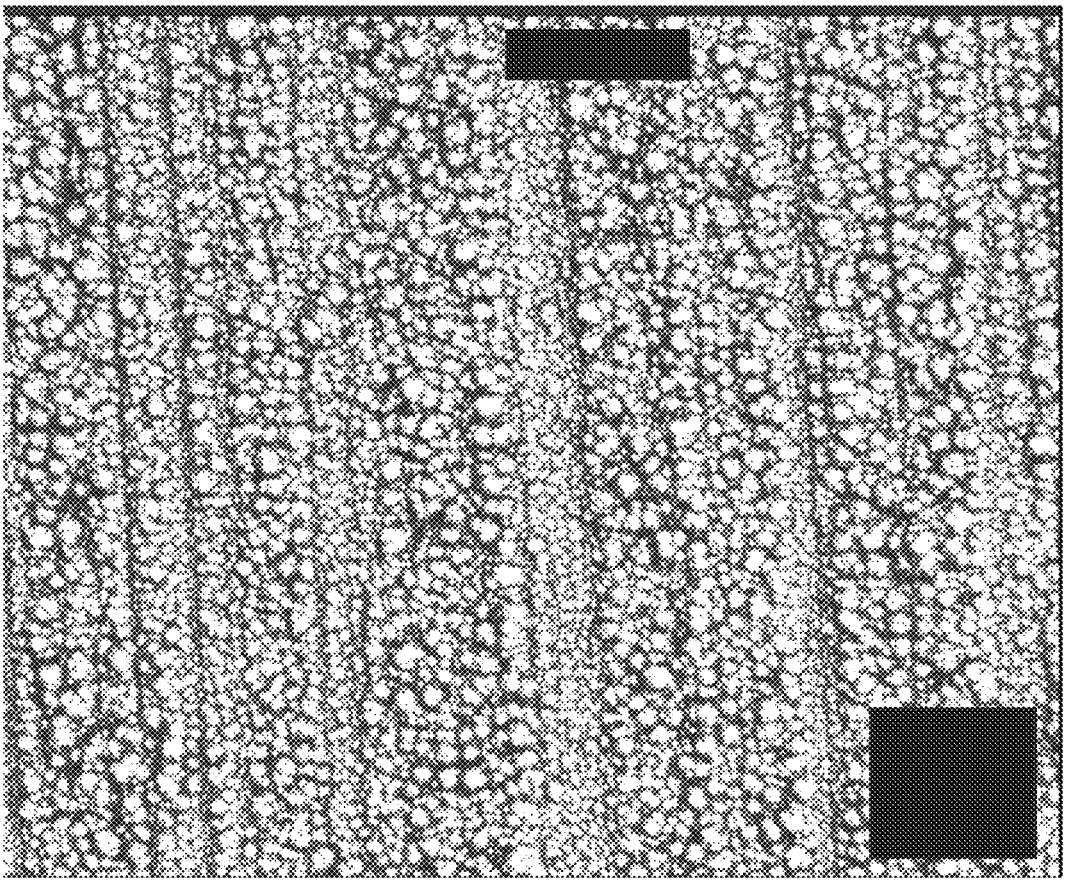
Figure 6F:
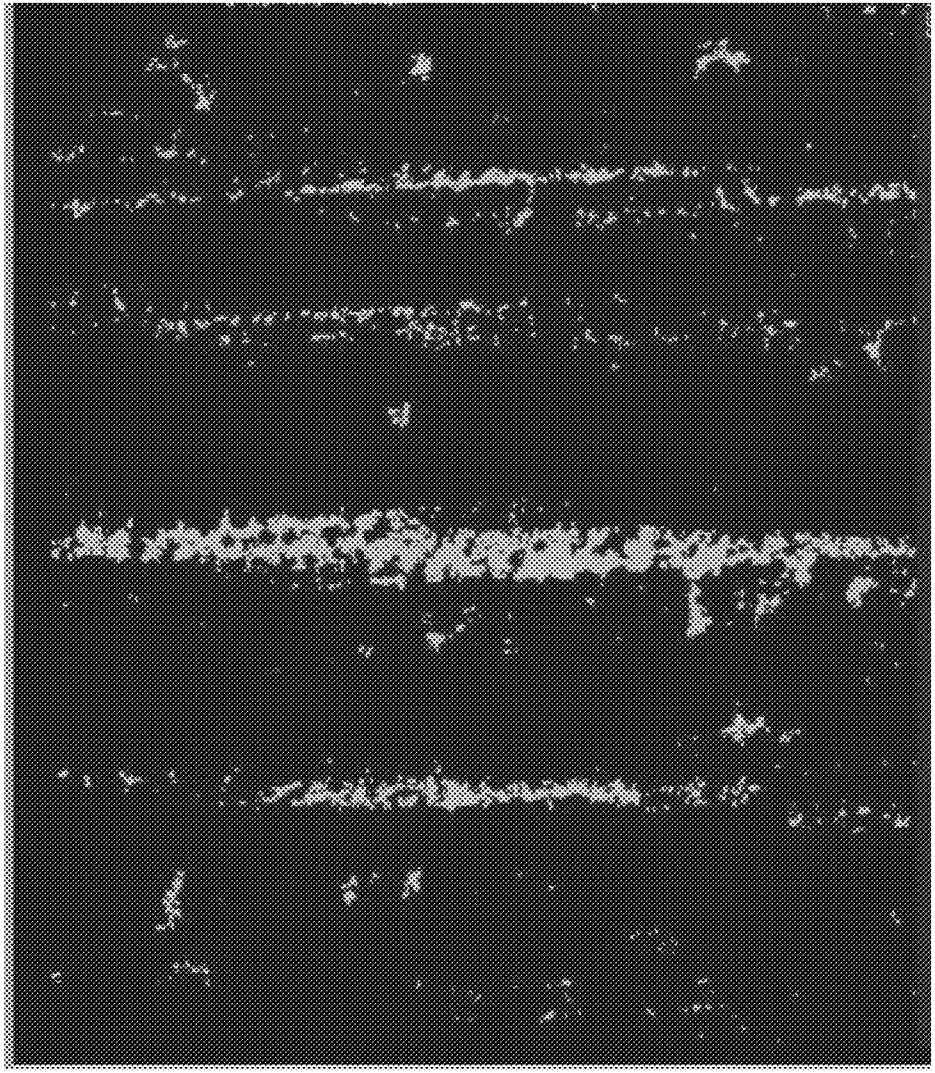
Figure 6G:
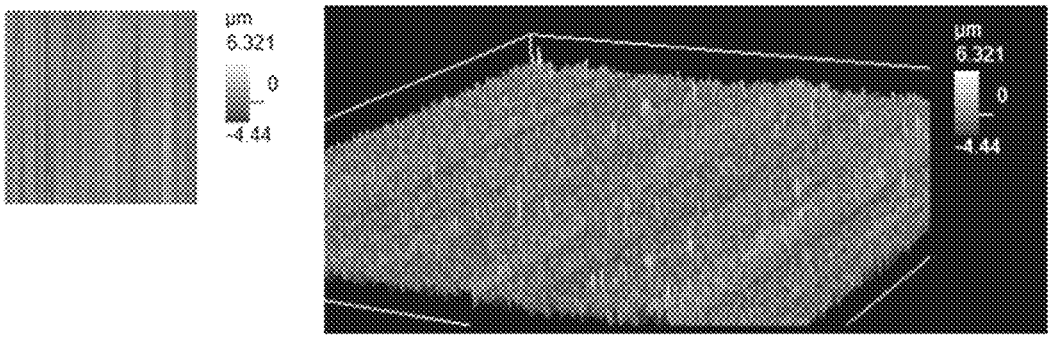

FIG. 2 depicts diagrams for describing the above-mentioned virtual plane for explaining the present embodiment and the characteristics of the present embodiment obtained based on the same. FIG. 2(*a*) is a diagram schematically depicting the maximum height roughness SRz of the roughened nickel plated layer 12 in the present embodiment and the virtual planer region A. FIG. 2(*b*) is a schematic diagram of a case where binarization is conducted in the valley region B and the other, in a case where the roughened nickel plated layer 12 is cut along the virtual planer region A.

As depicted in FIG. 2(*a*), in a case where the surface of the roughened nickel plated layer is observed three-dimensionally, a shape where pluralities of ridges and valleys are present is observed. A schematic diagram of a case where, letting the size of addition of the height of the highest ridge and the depth of the deepest valley in the observation region be SRz, a plane is acquired at a position of one-fourth (0.25) from the lower side in the height direction (Z direction in FIG. 2(*a*)) is the virtual planer region A depicted in FIG. 2(*b*).

As depicted in FIG. 2(*b*), in the virtual planer region A, the valley region B and other part (ridges and valleys whose depth is less than the plane) are present. In other words, the valley region B indicated by slant lines is said to be a region of a recessed part hollowed downward from a reference plane when the reference plane parallel to the main plane is acquired at a height of one-fourth of SRz.

In the present embodiment, it is preferable that the valley region B satisfy the above-mentioned condition (i).

In other words, as depicted in FIG. 2(*b*), as the condition (i), the plurality of valley regions B present in the virtual planer region A preferably have length $L_{B1}$, $L_{B2}$, $L_{B3}$, . . . in the rolling direction RD of less than 40 μm in a direct distance.

Next, as the condition (ii), in a case where a plurality of valley regions B are present in a straight line L of a given length of 80 μm parallel to the rolling direction RD, the total length (D1+D2+ . . . ) of parts D1, D2, . . . which are parts of intersection of the straight line L and the valley regions B and the lengths of which are equal to or more than 10 μm is preferably less than 50 μm.

Further, the surface state of the roughened nickel plated layer 12 in the present embodiment can be defined by three-dimensional surface property parameters defined in ISO-25178-2:2012 (corresponding JIS B 0681-2:2018).

For example, by defining Str which is a parameter representing the aspect ratio of texture (that is, anisotropy), it is possible to restrain generation of unevenness or grooves (formation unevenness) in the roughened nickel plated layer 12. In other words, by setting Str to be equal to or more than 0.1, the obtained roughened nickel-plated material 1 whose anisotropy is controlled can be formed. Str is preferably equal to or more than 0.15, more preferably equal to or more than 0.2, further preferably equal to or more than 0.3, and particularly preferably equal to or more than 0.4. The upper limit for Str is 1, and Str in the present embodiment is equal to or less than 1.0 as well.

In this way, by controlling the anisotropy of the roughened nickel-plated material 1, the following merits are obtained. A first merit resides in that, while, in a case where anisotropy is conspicuous, brittleness may be present in one direction in regard to adhesion strength to a bonded resin or the like and corrosion resistance, the roughened nickel-plated material in the present embodiment is lowered in anisotropy and therefore, can be used suitably for use where anisotropy of extreme characteristics is undesired. A second merit is as follows. For example, when the roughened nickel-plated material 1 is cut to a predetermined size and is used as a material of food cans, beverage cans, battery cans, and the like as a cut material, if the roughened nickel-plated material 1 is uniform upon visual observation but has anisotropy in a microscopic range, production while being restricted in the direction of the cut material is needed for exhibiting the material performance, so that productivity may be lowered.

Since anisotropy can be controlled even for the cut material in the present embodiment, for example, production can be performed without being restricted by the direction of the cut material at the time of production, so that productivity is markedly enhanced.

Note that, in regard to the surface state of the roughened nickel plated layer 12 in the present embodiment, other parameters than Str described above that are favorably defined and their numerical value ranges are as follows. Note that all these parameters are disclosed in ISO-25178-2:2012 (corresponding JIS B 0681-2:2018), and therefore, detailed description thereof is omitted here.

Sku: equal to or more than 3.0
Sa (μm): 0.2 to 1.3
Sk (μm): 1.0 to 4.0
Vvc (μm$^3$/μm$^2$): 0.6 to 3.0
Vmc (μm$^3$/μm$^2$): 0.45 to 2.0

By defining each parameter as above, formation unevenness of the roughened nickel-plated material can be restrained more, which is favorable. Note that, from the viewpoints of restraining of anisotropy, enhancement of adhesion to another member, plating adhesion, and the like, the parameters are more preferably controlled to within the following ranges.

Sku: equal to or more than 3.32
Sa (μm): 0.36 to 1.2
Sk (μm): 1.3 to 4.0
Vvc (μm$^3$/μm$^2$): 0.7 to 2.5
Vmc (μm$^3$/μm$^2$): 0.5 to 1.5

Note that the above-mentioned three-dimensional surface property parameters Str, Sku, Sa, Sk, Vvc, Vmc, and the like are preferably measured by a laser microscope.

In the present embodiment, the reason why, by the above-mentioned specification, the generation of unevenness or grooves in the roughened nickel plated layer (hereinafter also referred to as "formation unevenness") can be restrained is as follows.

In other words, as the characteristic in a case where the roughened nickel plated layer is grown by electroplating, as also described in PTL 2 and/or PTL 3 described above, it has been confirmed that cores of primary particles of nickel are liable to be preferentially precipitated on projected parts (inclusive of projected parts formed by previously precipitated nickel particles).

Therefore, in a case of forming a roughened nickel plated layer having a higher roughness, it is desirable that the ruggedness of the base material 11 be larger. However, if the ruggedness of the base material is too large, roughening may be formed partially. In view of this, for forming a plating having a uniform height over a wide range, as a technique of flattening while leaving a certain degree of roughness of projected parts (ridges) of the base material, the present inventors paid attention to control of surface shape of the rolled material. However, even in flat base material finish in ordinary nickel plating and in a range of roughness free of variability of plating formation, it has been found that new problems are present in roughened nickel plating.

Figure 7:
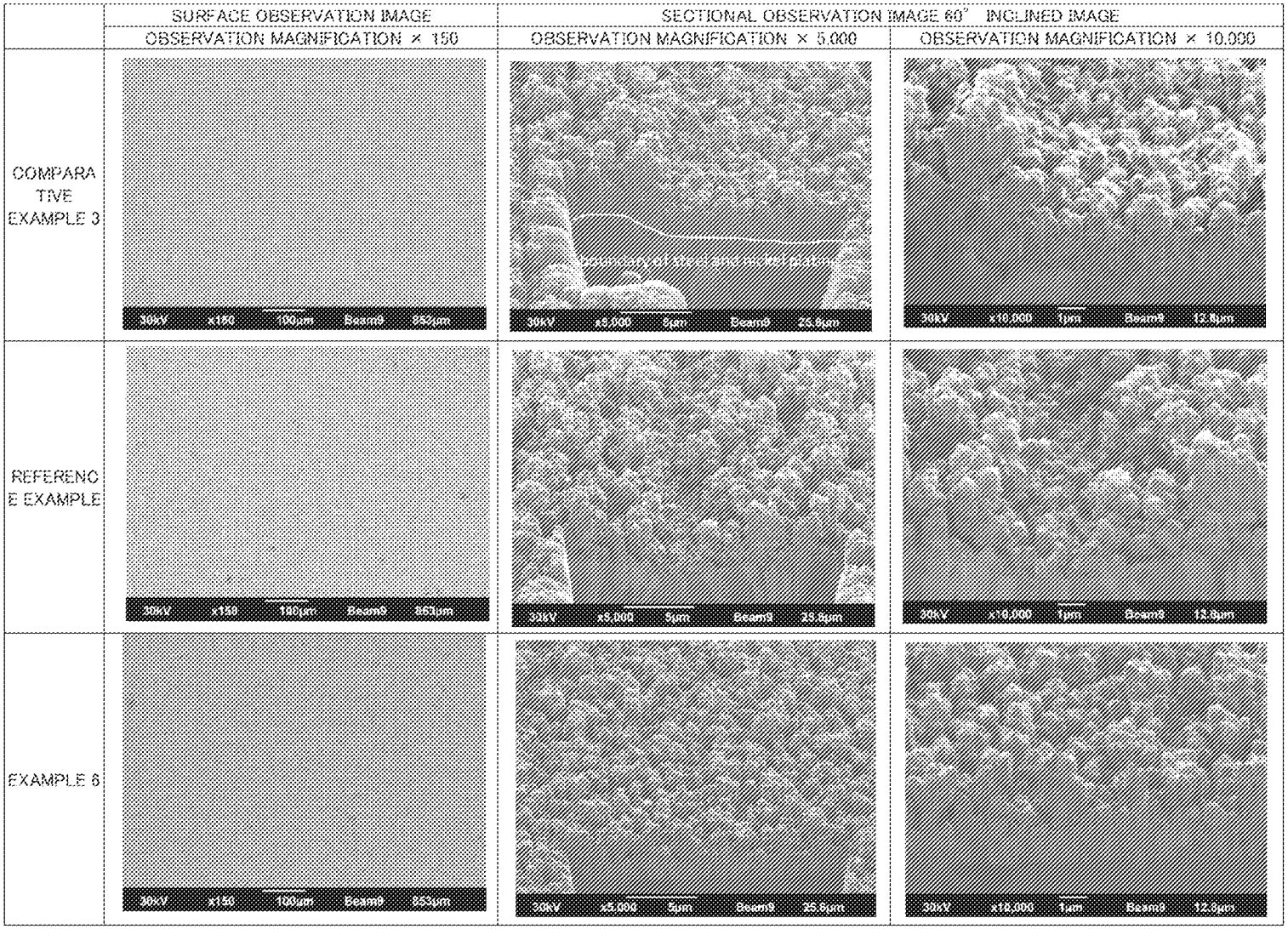
FIG. 7 is a diagram depicting the surfaces and the like of roughened nickel-plated materials obtained in Example, Comparative Example and Reference Example of the present embodiment.

In other words, in a case of observing the whole part of the roughened plated material in a wide range, the roughened nickel layer is formed on the whole surface basis, as indicated by a low magnification image (×150) of FIG. 7. Therefore, there is no problem as to characteristics required in a wide range (for example, a case of adhesion to resin or the like in a wide range). In addition, even in observation of an extremely minute range as indicated by a high magnification image (×10,000) of FIG. 7, it can be confirmed that aggregates of particles of roughened nickel are formed on the whole surface of the base material 11. However, upon observation on the whole surface basis from the front surface side of the height in medium magnifications as FIGS. 4 to 6, it was found that there are cases where groove-formed regions (recessed parts) of regions on the order of several tens of micrometers are formed, separately from the height differences among individual aggregates.

Such grooves of the regions on the order of several tens of micrometers are less distinguishable from a partial sectional image such as the high magnification image of FIG. 7. According to the present inventors' investigations, such grooves of the regions on the order of several tens of micrometers are formed because, even if flattening is conducted by rolling, it is presumed that, in the recessed parts having a certain degree of area such as rolling streaks of the base material 11, the particles and aggregates for forming the roughened nickel plating are grown with difficulty. Further, since the roughened nickel plating is liable to grow to an ordinary height or to a larger height in the periphery of the recessed parts, it is presumed that the ruggedness difference after roughened nickel appears more conspicuously than the ruggedness difference of the rolling streaks before roughened nickel and that the recessed parts become larger groove forms.

As a result, it is presumed that the height of the roughened nickel plated layer formed on the recessed parts due to the rolling streaks of the base material 11 is low as compared to the height of the roughened nickel plated layer formed on the projected parts due to the rolling streaks. Besides, it was confirmed, from an actual surface observation image, that, when such reduced-height parts and the surroundings are observed, the reduced-height parts are observed in groove form.

As a result of repeated experiments conducted by the present inventors, it was confirmed that, by setting the surface state (the state of ruggedness due to rolling streaks, surface roughness, etc.) of the base material 11 to a specified state, the groove parts of the roughened nickel plated layer formed on the recessed parts of the rolling streaks as described above can disappear.

Further, as a result of extensive and intensive investigations of the method for representing the surface state of the roughened nickel plated layer 12, it was found out that, by expressing the above-mentioned conditions (i) and (ii), the problem and effect aimed at by the present inventors can be exhibited.

Note that, in the present embodiment, the valley regions B are present in plurality ($B_1$, $B_2$, $B_3$, . . . ) in the virtual planer region A, as described above. The maximum CLmax of the circumferential lengths CL ($CL_1$, $CL_2$, $CL_3$, . . . ) of the individual valley regions B is preferably less than 500 μm. In other words, the circumferential length of the valley regions B in the virtual planer region A is preferably shorter than a predetermined length.

That is, in a case where the circumferential length CL is longer than a predetermined length, it is considered that a groove form is formed in the roughened nickel plated layer 12 as described above, which is unfavorable. More preferably, the CLmax is less than 100 μm.

In addition, in the present embodiment, the maximum of the maximum diameters of the individual valley regions B is preferably equal to or less than 25 μm. In other words, the maximum MDmax of the maximum diameters MD ($MD_1$, $MD_2$, $MD_3$, . . . ) of the individual valley regions B is preferably equal to or less than 25 μm. Note that the maximum diameters of the valley regions B can be measured by a known measuring device.

Note that, in the present embodiment, the roughened nickel plated layer 12 may include therein a underlying nickel layer or a coating nickel layer. Note that, in regard to the underlying nickel layer and the coating nickel layer, the contents disclosed in PTL 2 and PTL 3 described above and, further, Japanese Patent Application No. 2019-108779 can be applied, as required, and therefore, a detailed description thereof is omitted in the present application.

<Method for Manufacturing Roughened Nickel-Plated Material>

Next, a method for manufacturing the roughened nickel-plated material 1 in the present embodiment will be described.

The method for manufacturing the roughened nickel-plated material 1 in the present embodiment is generally the same as the methods described in PTL 2 and PTL 3 and Japanese Patent Application No. 2019-108779 described above, but has a characteristic in that the surface states of the base material 11 or the underlying nickel plated layer 13 are set to a predetermined state, so that the characteristic part will be mainly described.

The method for manufacturing the roughened nickel-plated material 1 of the present embodiment is characterized by having a base material surface treatment step in which SRzjis of the surface of the base material 11 is made to be equal to or more than 0.5 μm and less than 1.7 μm and a roughened nickel plating step of forming a roughened nickel plated layer 12 on the base material 11.

The above-mentioned base material surface treatment step is specifically preferably a rolling step of the base material 11, and further preferably a cold rolling step or a temper rolling step. Note that the reduction ratio, the surface roughness of the surfaces of the rolling rolls, and the like used in the rolling step can be adjusted as required in known ranges.

On the other hand, by this base material surface treatment step, SRzjis of the surface of the base material 11 is preferably made to be equal to or more than 0.5 μm and less than 1.7 μm.

By setting SRzjis of the surface of the base material 11 to this value, generation of unevenness, grooves, or the like in the roughened nickel plated layer 12 as described above can be restrained.

Note that, in a case where final finishing is conducted by the cold rolling step or the temper rolling step, for setting SRzjis of the surface of the base material 11 to be equal to or more than 0.5 μm and less than 1.7 μm, surface roughness of the rolls (final rolls) for performing final finishing of the surface of the base material 11 is important. A preferable range of the roll roughness is Ra=0.01 to 0.5 μm.

Particularly, in the case where the final finishing of the base material 11 is conducted by the cold rolling step (in the case where the cold rolling step is the final finishing of the base material surface), the surface roughness of the rolls for performing rolling with a reduction ratio of equal to or more than 51 is important, and the surface roughness of the rolls is preferably in the above-mentioned range.

Note that the reduction ratio (reduction ratio=((plate thickness before rolling)−(sheet thickness after rolling))/(plate thickness before rolling)×100) in the cold rolling step is preferably equal to or more than 10%.

In addition, in a case where the final finishing of the base material 11 is finished with the temper rolling step, the final rolling rolls before the temper rolling step are preferably in the above-mentioned range. Incidentally, the reduction ratio in the temper rolling step is generally equal to or more than 0.1% and less than 5%.

Alternatively, the method for manufacturing the roughened nickel-plated material 1 in the present embodiment is characterized by having a step of forming a underlying nickel plated layer 13 with Sku of the surface of equal to or more than 4.0 on the base material 11 which is a metal and a roughened nickel plating step of forming the roughened nickel plated layer 12 on the above-mentioned underlying nickel plated layer 13.

Further, Vvc of the surface of the above-mentioned underlying nickel plated layer is preferably equal to or less than 0.45 $\mu m^3/\mu m^2$.

Note that examples of the method for controlling the above-described parameter Sku or parameter Vvc of the surface of the underlying nickel plated layer 13 into the above-mentioned numerical value range include a method of controlling the roughness of the base material 11, a method of controlling the roughness by polishing or temper rolling of the underlying nickel plated layer 13, and a method of controlling by plating conditions at the time of forming the underlying nickel plated layer 13. Of these, examples of the method of controlling by the plating conditions at the time of forming the underlying nickel plated layer 13 include thickening of the underlying nickel plating and a method of controlling the particle diameter of the underlying nickel plating.

In addition, for setting SRzjis of the surface of the base material 11 to be equal to or more than 0.5 μm and less than 1.7 μm, the final finishing of the surface may be conducted by polishing, and, for example, mechanical polishing (buffing) or chemical polishing may be applied.

Note that, in the present embodiment, the roughened nickel plating step for forming the roughened nickel plated layer 12 on the base material 11 or on the underlying nickel plated layer 13 is generally the same as the methods described in PTL 2 and PTL 3 described above and Japanese Patent Application No. 2019-108779, and therefore, detailed description thereof is omitted.

In the present embodiment, nickel particulate matter may be precipitated by a roughened nickel plating bath on the base material 11 or on the underlying nickel plated layer 13. In addition, a coating nickel plated layer may be precipitated, as required, on the roughened nickel plated layer 12.

EXAMPLES

The present invention will be specifically described below by presenting Examples, but the present invention is not limited to the Examples.

Example 1

First, a cold rolled sheet (thickness 0.1 mm) of a low carbon aluminum-killed steel was prepared as a base material. The cold rolled sheet was obtained by performing final rolling at normal temperature by use of the rolling conditions (reduction ratio and rolling rolls) set forth in Table 1 such that the surface shape (SRa and Srzjis) set forth in Table 1 is obtained. Next, alkali electrolytic degreasing, and pickling by immersion in sulfuric acid were conducted, to obtain the base material 11. Then, electroplating was conducted under the following conditions by use of a underlying nickel plating bath with the following bath composition, to form a underlying nickel layer on the base material 11.

<<Underlying Nickel Plating Conditions>>

Bath composition: nickel sulfate hexahydrate 250 g/L, nickel chloride hexahydrate 45 g/L, boric acid 30 g/L pH 4.2

Bath temperature 60° C.

Current density 10 $A/dm^2$

Plating time 30 seconds

Note that parameters of the underlying nickel layer obtained were as set forth in Table 3.

Next, the steel sheet formed with the above-mentioned underlying nickel layer was subjected to electroplating (roughened nickel plating) under the following conditions by use of a roughened nickel plating bath with the following bath composition, to precipitate nickel particulate matter on the underlying nickel layer.

<<Roughened Nickel Plating Conditions>>

Bath composition: Nickel sulfate hexahydrate 20 g/L, nickel chloride hexahydrate 20 g/L, ammonium sulfate 20 g/L pH 6

Bath temperature 30° C.

Current density 15 $A/dm^2$

Plating time 26 seconds

Next, the steel sheet formed with the above-mentioned roughened nickel plated layer was subjected to electroplating (coating nickel plating) under the following conditions by use of the following bath composition, to form a roughened nickel plated layer 12 on the base material 11, thereby obtaining a roughened nickel plating material 1 in Example 1.

<<Coating Nickel Plating Conditions>>

Bath composition: Nickel sulfate hexahydrate 250 g/L, Nickel chloride hexahydrate 45 g/L, boric acid 30 g/L pH 4.2

Bath temperature 60° C.

Current density 10 A/dm$^2$

Plating time 30 seconds

Then, the roughened nickel-plated material obtained was subjected to various measurements and evaluation. Details of the measurement and evaluation will be described below. In addition, the results are set forth in Table 2.

<<Three-Dimensional Roughness Measurement (1)>>

In regard to the base material 11 before formation of the roughened nickel plated layer, the surface formed with the underlying nickel plated layer 13 of the base material 11, and the surface formed with the roughened nickel plated layer 12 of the roughened nickel-plated sheet 1, the visual field of 97 μm×129 μm (longitudinal×transverse) (measurement visual field width 129 μm, measurement area approximately 12,500 μm$^2$ (12,500±100)) was scanned with the measurement direction in the direction perpendicular to the rolling direction, by use of a laser microscope (model number: OLS3500, made by Olympus Corporation) according to JIS B0601:2013, and thereafter analysis was made by use of analysis software (software name: LEXT-OLS) under the condition of analysis mode being set to roughness analysis, to measure numerical values of SRp, SRv, SRz, SRc, SRa, SRq, and SRzjis. Note that the cut-off value at the time of measuring by the laser microscope was a wavelength on the order of 43 μm (on representation 43.2) which is one-third of the measurement visual field width (129 μm).

The parameters obtained are set forth in Tables 2 to 4.

<<Three-Dimensional Roughness Measurement (2)>>

In regard to the surface formed with the underlying nickel plated layer 13 of the base material 11 before formation of the roughened nickel plated layer and the surface formed with the roughened nickel plated layer 12 of the roughened nickel-plated sheet 1, three-dimensional surface property parameters (arithmetic mean height Sa, kurtosis Sku, aspect ratio of texture Str, level difference of core part Sk, core part space volume Vvc, and core part real volume Vmc) were measured by use of a laser microscope (3D measurement laser microscope LEXT OLS5000, made by Olympus Corporation) according to ISO 25178-2:2012.

Specifically, first, a laminated image with a visual field of 591 μm×591 μm formed by scanning 25 images (5 images×5 images) under the condition of an objective lens 100 magnification (lens name: MPLAPON100XLEXT) was acquired, to obtain an image for analysis. Next, in regard to the image for analysis, noise removal and inclination correction which are automatic correction treatments were conducted using an analysis application.

Thereafter, an icon of surface roughness measurement was clicked to perform analysis, to obtain three-dimensional surface property parameters (arithmetic mean height Sa, kurtosis Sku, aspect ratio of texture Str, level difference of core part Sk, core part space volume Vvc, and core part real volume Vmc).

Note that all of filter conditions in analysis (F calculation, S filter, and L filter) were not set, and analysis was conducted under the condition of absence.

The parameters obtained are set forth in Table 3 and Table 4.

<<Nickel Deposition Amount Measurement>>

The nickel deposition amount was measured by a fluorescent X-ray device, and the values obtained are set forth in Table 2. After steps of formation of the underlying nickel layer, the nickel particulate matter, and nickel coating, the nickel deposition amount was measured by the fluorescent X-ray device, to determine the nickel amounts in the roughened nickel plated layer (underlying nickel layer, nickel particulate matter, and nickel coating). Note that a specific measurement method is similar to the method described in Japanese Patent Application No. 2019-108779, and therefore, detailed description thereof is omitted here.

<<Glossiness>>

In regard to the surface of the roughened nickel plated layer, 60° glossiness and 85° glossiness were measured by use of a gloss meter (product name "VG 7000," made by NIPPON DENSHOKU INDUSTRIES CO., LTD.) according to JIS Z8741. The results are set forth in Table 1.

<<Measurement of Length, Circumferential Length, and Maximum Diameter of Valley Region B>>

Measurement of the length, the circumferential length, and the maximum diameter of the valley region B was conducted by scanning with a measurement range of 97×129 μm by use of a laser microscope (model number: OLS3500, made by Olympus Corporation) similarly to the above-mentioned measurement of three-dimensional roughness, and thereafter by using the analysis software with the method described above.

Note that, in regard to the present or absence of formation unevenness of a length of equal to or more than 40 μm in the rolling direction or the plate passing direction RD, given ten visual fields with the above-mentioned range (97×129 μm) as a visual field were observed, and a case where formation unevenness of a length of equal to or more than 40 μm was not observed in equal to or more than seven visual fields was assumed to be less than 40 μm.

<<Tensile Strength Test>>

<Adhesion (T Peel Strength) of Resin>

The roughened nickel-plated sheets obtained in Example and Comparative Example were cut to produce two test sheets of a size of width of 15 mm and a length of 50 mm, and these were made to be T peel test pieces. The two T peel pieces were bent at an angle of 90° at a position of a length of 20 mm.

Next, the surfaces having the roughened nickel layer of the T peel test pieces are set to face each other, and a polypropylene resin film (made by Mitsubishi Chemical Corporation, product name "Modic"/polypropylene resin double-layer film, joint surface as an object of evaluation is a joint surface between the polypropylene resin and the T peel test piece, the product name "Modic" is an adhesive layer for stabilizing the test) was sandwiched therebetween. Heat sealing was conducted under the conditions of a temperature of 190° C., pressing time of five seconds, and a heat sealing pressure of 2.0 kgf/cm$^2$, to join the two T peel test pieces through the polypropylene resin film. The position where the polypropylene resin film is sandwiched is an end portion in the length direction of the T peel test specimen, and the polypropylene resin film as a whole is the joint surface.

The T peel test specimen produced in this way was subjected to a tensile test by use of a tensile tester (universal testing machine Tensilon RTC-1350A, made by ORIENTEC Co., Ltd.) to measure the peel load (T peel strength). The measurement conditions were at room temperature and a tensile speed of 10 mm/min. It can be determined that, as the T peel strength is higher, adhesion to the resin is better. Example and Comparative Example both gave a value of equal to or more than 8 N/15 mm.

<Coincidence Rate of Strength>

The roughened nickel plated layer 12 of the roughened nickel-plated sheet 1 was subjected to the above-mentioned T peel strength test in two directions, namely, the direction parallel to the rolling direction and the direction perpendicular to the rolling direction. Coincidence rate (%) of the T peel strength in the two directions is set forth in Table 5. Note that the coincidence rate (%) was obtained by the following formula.

Coincidence rate (%)="Strength in direction 1"/"Strength in direction 2"×100

Here, the above-mentioned direction 1 and direction 2 are defined as "(strength in direction 1)<(strength in direction 2)." In other words, upon the test of T peel strength in the above-mentioned two directions, the direction where the T peel strength is higher is direction 2, and the direction where the T peel strength is lower is direction 1.

From the results set forth in Table 5, in the present embodiment, a coincidence rate of a magnitude of equal to or more than 80% was obtained, while, in Comparative Examples, it was indicated that the difference in magnitude in the two directions is large. From the results, it was indicated that anisotropy in the two directions can be restrained in the present embodiment.

Examples 2 to 5

Operations were conducted similarly to Example 1, except for using the base materials as set forth in Table 1 and Table 2. The results are set forth in Table 2. In addition, an appearance photograph of the roughened nickel-plated material obtained in Example 3, a sectional curve in a given section, a luminance image, and a binarized image are depicted in FIGS. 3(*a*), 3(*b*), 3(*c*), and 3(*d*) and a three-dimensional surface property photograph at the time of measurement of Str is depicted in FIG. 3(*e*). Further, an appearance photograph of the roughened nickel-plated material obtained in Example 5, a sectional curve in a given section, a luminance image, and a binarized image are depicted in FIGS. 4(*a*), 4(*b*), 4(*c*), and 4(*d*).

Example 6

The cold rolled sheet used in Example 1 was subjected to temper rolling by use of temper rolling rolls having surface roughness of final rolling rolls set forth in Table 1. The reduction ratio at the time of temper rolling was as set forth in Table 1. Operations other than this were conducted similarly to Example 1. The results are set forth in Table 2. In addition, an appearance photograph of the roughened nickel-plated material obtained, a sectional curve in a given section, a luminance image, and a binarized image are depicted in FIGS. 5(*a*), 5(*b*), 5(*c*), 5(*d*), 5(*e*), 5(*f*), 5(*g*), and 5(*h*).

Comparative Examples 1 to 3

Operations were conducted similarly to Example 1, except for using the base materials as set forth in Table 1 and Table 2. The results are set forth in Table 2. A three-dimensional surface property photograph at the time of measurement of Str in Comparative Example 1 is depicted in FIG. 6(*a*). A three-dimensional surface property photograph at the time of measurement of Str in Comparative Example 2 is depicted in FIG. 6(*b*). An appearance photograph of the roughened nickel-plated material, a sectional curve in a given section, a luminance image, and a binarized image, which were obtained in Comparative Example 3, are depicted in FIG. 6(*c*), and a three-dimensional surface property photograph at the time of measurement of Str obtained in Comparative Example 3 is depicted in FIG. 6(*d*).

Reference Example

Operations were conducted similarly to Example 1, except that the thickness of the underlying nickel plating was 5 μm. The results are depicted in FIG. 7.

TABLE 1

| | Surface roughness of final rolling rolls (μm) | Reduction ratio (%) |
|---|---|---|
| Example 1 | 0.03 to 0.19 | 21.90 |
| Example 2 | 0.03 to 0.19 | 19.40 |
| Example 3 | 0.20 to 0.45 | 16.70 |
| Example 4 | 0.20 to 0.45 | 16.70 |
| Example 5 | 0.03 to 0.19 | 16.70 |
| Example 6 | 0.01 to 0.10 | 1.00 |
| Comparative Example 1 | 0.51 to 0.80 | 5.60 |
| Comparative Example 2 | 0.51 to 0.80 | 9.10 |
| Comparative Example 3 | 0.51 to 0.80 | Unmeasured |

TABLE 2

| | Base material (Original sheet) | | | | | | | | |
|---|---|---|---|---|---|---|---|---|---|
| | Roughness information (Cut-off 43 μm) | | | | | | | Glossiness | |
| | SRp (μm) | SRv (μm) | SRz (μm) | SRc (μm) | SRa (μm) | SRq (μm) | SRzjis (μm) | Gs60° | Gs85° |
| Example 1 | 0.62 | 0.85 | 1.47 | 0.27 | 0.12 | 0.16 | 1.45 | 139 | 87 |
| Example 2 | 0.44 | 0.74 | 1.18 | 0.21 | 0.10 | 0.13 | 1.14 | 174 | 90 |
| Example 3 | 0.57 | 1.00 | 1.57 | 0.26 | 0.11 | 0.15 | 1.51 | 122 | 98 |
| Example 4 | 0.65 | 0.87 | 1.52 | 0.33 | 0.14 | 0.18 | 1.47 | 108 | 83 |
| Example 5 | 0.48 | 0.98 | 1.46 | 0.22 | 0.10 | 0.14 | 1.44 | 144 | 85 |
| Example 6 | 0.22 | 0.76 | 0.98 | 0.09 | 0.04 | 0.06 | 0.92 | 432 | 113 |
| Comparative Example 1 | 0.95 | 1.00 | 1.95 | 0.48 | 0.21 | 0.25 | 1.91 | 95 | 60 |

TABLE 2-continued

| | Base material (Original sheet) | | | | | | | | |
|---|---|---|---|---|---|---|---|---|---|
| | Roughness information (Cut-off 43 μm) | | | | | | | Glossiness | |
| | SRp (μm) | SRv (μm) | SRz (μm) | SRc (μm) | SRa (μm) | SRq (μm) | SRzjis (μm) | Gs60° | Gs85° |
| Comparative Example 2 | 0.79 | 1.15 | 1.93 | 0.42 | 0.24 | 0.29 | 1.81 | 84 | 64 |
| Comparative Example 3 | 0.86 | 0.90 | 1.76 | 0.42 | 0.18 | 0.21 | 1.72 | 103 | 66 |

TABLE 3

| | Underlying Ni plating | | | | | | | | |
|---|---|---|---|---|---|---|---|---|---|
| | SRa (μm) | SRzjis (μm) | Ni deposition amount ($g/m^2$) | Str | Sku | Sa (μm) | Sk (μm) | Vvc ($\mu m^3/\mu m^2$) | Vmc ($\mu m^3/\mu m^2$) |
| Example 1 | 0.12 | 1.6 | 9.0 | 0.80 | 6.261 | 0.25 | 0.50 | 0.25 | 0.27 |
| Example 2 | 0.08 | 1.9 | 9.2 | 0.68 | 5.527 | 0.24 | 0.46 | 0.24 | 0.27 |
| Example 3 | 0.17 | 1.8 | 9.2 | 0.04 | 4.753 | 0.18 | 0.57 | 0.27 | 0.20 |
| Example 4 | Unmeasured | Unmeasured | 6.7 | 0.22 | 7.124 | 0.25 | 0.63 | 0.36 | 0.24 |
| Example 5 | 0.11 | 1.5 | 9.4 | 0.78 | 8.459 | 0.33 | 0.50 | 0.28 | 0.34 |
| Example 6 | 0.04 | 0.9 | 9.8 | 0.29 | 72.347 | 0.06 | 0.16 | 0.07 | 0.06 |
| Comparative Example 1 | 0.18 | 1.5 | 9.3 | 0.07 | 2.848 | 0.35 | 1.09 | 0.57 | 0.40 |
| Comparative Example 2 | 0.15 | 2.5 | 9.4 | 0.04 | 3.517 | 0.29 | 0.90 | 0.46 | 0.31 |
| Comparative Example 3 | 0.18 | 1.5 | 8.7 | 0.08 | 2.943 | 0.33 | 1.14 | 0.48 | 0.38 |

TABLE 4

| | Roughened Ni plating | | | | | | | | | | | | | | |
|---|---|---|---|---|---|---|---|---|---|---|---|---|---|---|---|
| | Sra (μm) | SRzjis (μm) | Ni deposition amount ($g/m^2$) | Condition (i) | Condition (ii) | CLmax (μm) | MD (μm) | Brightness of color L* | Glossiness Gs85° | Str | Sku | Sa (μm) | Sk (μm) | Vvc ($\mu m^3/\mu m^2$) | Vmc ($\mu m^3/\mu m^2$) |
| Example 1 | 0.57 | 7.2 | 14.9 | Less than 40 μm | Less than 50 μm | 97.8 | Equal to or less than 25 | 45.2 | 9.1 | 0.65 | 3.547 | 0.76 | 2.32 | 1.09 | 0.84 |
| Example 2 | 0.53 | 7.0 | 13.9 | Less than 40 μm | Less than 50 μm | 53.2 | Equal to or less than 25 | 43.9 | 12.1 | 0.42 | 3.734 | 0.61 | 1.85 | 0.89 | 0.67 |
| Example 3 | 0.58 | 6.1 | 14.2 | Less than 40 μm | Less than 50 μm | 73.0 | Equal to or less than 25 | 44.1 | 14.4 | 0.25 | 4.021 | 0.67 | 2.11 | 1.06 | 0.75 |
| Example 4 | 0.60 | 7.3 | 15.9 | Less than 40 μm | Less than 50 μm | 59.4 | Equal to or less than 25 | 44.4 | 11.4 | 0.18 | 3.781 | 0.68 | 2.07 | 1.04 | 0.74 |
| Example 5 | 0.57 | 6.8 | 13.9 | Less than 40 μm | Less than 50 μm | 33.0 | Equal to or less than 25 | 43.9 | 9.6 | 0.69 | 4.959 | 0.72 | 2.14 | 1.02 | 0.78 |
| Example 6 | 0.39 | 6.2 | 13.1 | Less than 40 μm | Less than 50 μm | 34.7 | Equal to or less than 25 | 42.7 | 23.9 | 0.91 | 3.162 | 0.40 | 1.30 | 0.65 | 0.45 |
| Comparative Example 1 | 0.74 | 7.1 | 14.0 | More than 40 μm | More than 50 μm | 118.6 | More than 25 | 45.2 | 13.7 | 0.03 | 2.905 | 0.88 | 2.82 | 1.38 | 0.99 |
| Comparative Example 2 | 0.82 | 7.5 | 14.6 | More than 40 μm | More than 50 μm | 1133.7 | More than 25 | 43.2 | 10.8 | 0.01 | 3.319 | 0.95 | 3.05 | 1.53 | 1.06 |

TABLE 4-continued

| | Roughened Ni plating | | | | | | | | | | | | | | |
|---|---|---|---|---|---|---|---|---|---|---|---|---|---|---|---|
| | Sra (μm) | SRzjis (μm) | Ni deposition amount ($g/m^2$) | Condition (i) | Condition (ii) | CLmax (μm) | MD (μm) | Brightness of color L* | Glossiness Gs85° | Str | Sku | Sa (μm) | Sk (μm) | Vvc ($\mu m^3/\mu m^2$) | Vmc ($\mu m^3/\mu m^2$) |
| Comparative Example 3 | 0.69 | 6.5 | 14.3 | More than 40 μm | More than 50 μm | 243.2 | More than 25 | 44.2 | 15.0 | 0.01 | 3.209 | 0.75 | 2.40 | 1.11 | 0.86 |

TABLE 5

| | Intensity difference coincidence rate |
|---|---|
| Example 1 | 94% |
| Example 2 | 89% |
| Example 3 | 85% |
| Example 4 | 80% |
| Example 5 | 100% |
| Example 6 | 95% |
| Comparative Example 1 | 72% |
| Comparative Example 2 | 68% |
| Comparative Example 3 | 50% |

According to the embodiment and Examples of the present invention as described above, it is possible to provide a roughened nickel-plated material capable of restraining generation of unevenness or grooves (formation unevenness) in the roughened nickel plated layer. The roughened nickel-plated material can be suitably applied as a material to, for example, beautiful food cans, beverage cans, battery cans, and the like and uses used by joining to another member, for example, various vessels required of adhesion to various members such as resin and an active substance, electronic apparatus members (substrate and the like), and battery members (casing, current collector, tab lead). In addition, since it is possible to provide a roughened nickel-plated material in which anisotropy is restrained, the roughened nickel-plated material can be applied to products for the above-mentioned uses without being restricted by the rolling direction of the base material, so that productivity is enhanced.

Note that the above-described embodiment and Examples can accept additional modification, deletion, or decoration in such ranges as not to depart from the gist of the present invention.

INDUSTRIAL APPLICABILITY

The roughened nickel-plated material of the present invention can exhibit excellent functionality by being used for uses used by joining to other members such as resin and an active substance, for example, material for vessels such as food cans, beverage cans, and battery cans, electronic apparatus members (substrate and the like), and battery members (casing, current collector, tab lead).

REFERENCE SIGNS LIST

1: Roughened nickel-plated material
11: Base material
12: Roughened nickel plated layer
13: Underlying nickel plated layer

The invention claimed is:

1. A roughened nickel-plated material
a base material that is a metal; and
a roughened nickel plated layer formed on at least one surface of the base material,
wherein Str of three-dimensional surface property parameters of the surface of the roughened nickel plated layer is equal to or more than 0.1, and
wherein brightness of color of the surface of the roughened nickel plated layer is 30 to 50 in L* value.

2. The roughened nickel-plated material according to claim 1, wherein, further, Sk of the three-dimensional surface property parameters of the surface of the roughened nickel plated layer is 1.0 to 4.0 μm.

3. The roughened nickel-plated material according to claim 1, wherein, further, Vvc of the three-dimensional surface property parameters of the surface of the roughened nickel plated layer is 0.6 to 3.0 $\mu m^3/\mu m^2$.

4. The roughened nickel-plated material according to claim 1, wherein, further, Vmc of the three-dimensional surface property parameters of the surface of the roughened nickel plated layer is 0.45 to 2.0 $\mu m^3/\mu m^2$.

* * * * *